US011939646B2

(12) United States Patent
Vecchio et al.

(10) Patent No.: US 11,939,646 B2
(45) Date of Patent: Mar. 26, 2024

(54) CORROSION AND WEAR RESISTANT NICKEL BASED ALLOYS

(71) Applicant: Oerlikon Metco (US) Inc., Westbury, NY (US)

(72) Inventors: James Vecchio, San Diego, CA (US); Justin Lee Cheney, Encinitas, CA (US); Jonathon Bracci, Carlsbad, CA (US); Petr Fiala, Fort Saskatchewan (CA)

(73) Assignee: OERLIKON METCO (US) INC., Westbury, NY (US)

( * ) Notice: Subject to any disclaimer, the term of this patent is extended or adjusted under 35 U.S.C. 154(b) by 91 days.

(21) Appl. No.: 17/288,186

(22) PCT Filed: Oct. 25, 2019

(86) PCT No.: PCT/US2019/058080

§ 371 (c)(1),
(2) Date: Apr. 23, 2021

(87) PCT Pub. No.: WO2020/086971

PCT Pub. Date: Apr. 30, 2020

(65) Prior Publication Data

US 2021/0404035 A1 Dec. 30, 2021

Related U.S. Application Data

(60) Provisional application No. 62/751,020, filed on Oct. 26, 2018.

(51) Int. Cl.
*C22C 19/05* (2006.01)
*C23C 4/06* (2016.01)

(52) U.S. Cl.
CPC ..... *C22C 19/056* (2013.01); *C23C 4/06* (2013.01)

(58) Field of Classification Search
CPC ..... C22C 19/056; C23C 4/06
See application file for complete search history.

(56) References Cited

U.S. PATENT DOCUMENTS

| | | | |
|---|---|---|---|
| 2,043,952 | A | 6/1936 | Ffield |
| 2,156,306 | A | 5/1939 | Rapatz |
| 2,507,195 | A | 5/1950 | Winearls |
| 2,608,495 | A | 8/1952 | Barry |
| 2,873,187 | A | 2/1959 | Dyrkaez et al. |
| 2,936,229 | A | 5/1960 | Shepard |
| 3,024,137 | A | 3/1962 | Witherell |
| 3,113,021 | A | 12/1963 | Witherell |
| 3,181,970 | A | 5/1965 | Witherell et al. |
| 3,303,063 | A | 2/1967 | Pietryka et al. |
| 3,448,241 | A | 6/1969 | Buckingham et al. |
| 3,554,792 | A | 1/1971 | Johnson |
| 3,650,734 | A | 3/1972 | Kantor et al. |
| 3,663,214 | A | 5/1972 | Moore |
| 3,724,016 | A | 4/1973 | Kumar et al. |
| 3,819,364 | A | 6/1974 | Frehn |
| 3,843,359 | A | 10/1974 | Fiene et al. |
| 3,859,060 | A | 1/1975 | Eiselstein et al. |
| 3,942,954 | A | 3/1976 | Frehn |
| 3,975,612 | A | 8/1976 | Nakazaki et al. |
| 4,010,309 | A | 3/1977 | Peterson |
| 4,017,339 | A | 4/1977 | Okuda et al. |
| 4,042,383 | A | 8/1977 | Petersen et al. |
| 4,066,451 | A | 1/1978 | Rudy |
| 4,110,514 | A | 8/1978 | Nicholson |
| 4,214,145 | A | 7/1980 | Zvanut et al. |
| 4,235,630 | A | 11/1980 | Baby |
| 4,240,827 | A | 12/1980 | Aihara |
| 4,255,709 | A | 3/1981 | Zatsepium et al. |
| 4,277,108 | A | 7/1981 | Wallace |
| 4,285,725 | A | 8/1981 | Gysel |
| 4,297,135 | A | 10/1981 | Giessen et al. |
| 4,318,733 | A | 3/1982 | Ray et al. |
| 4,362,553 | A | 12/1982 | Ray |
| 4,365,994 | A | 12/1982 | Ray |
| 4,415,530 | A | 11/1983 | Hunt |
| 4,419,130 | A | 12/1983 | Slaughter |
| 4,576,653 | A | 3/1986 | Ray |
| 4,596,282 | A | 6/1986 | Maddy et al. |
| 4,606,977 | A | 8/1986 | Dickson et al. |
| 4,635,701 | A | 1/1987 | Sare et al. |
| 4,638,847 | A | 1/1987 | Day |
| 4,639,576 | A | 1/1987 | Shoemaker |
| 4,666,797 | A | 5/1987 | Newman et al. |
| 4,673,550 | A | 6/1987 | Dallaire et al. |
| 4,762,681 | A | 8/1988 | Tassen et al. |
| 4,803,045 | A | 2/1989 | Ohriner et al. |
| 4,806,394 | A | 2/1989 | Steine |
| 4,818,307 | A | 4/1989 | Mori et al. |
| 4,822,415 | A | 4/1989 | Dorfman et al. |
| 4,888,153 | A | 12/1989 | Yabuki |
| 4,919,728 | A | 4/1990 | Kohl et al. |
| 4,943,488 | A | 7/1990 | Sung et al. |
| 4,957,982 | A | 9/1990 | Geddes |
| 4,966,626 | A | 10/1990 | Fujiki et al. |

(Continued)

FOREIGN PATENT DOCUMENTS

| | | |
|---|---|---|
| CN | 86102537 | 9/1987 |
| CN | 1033292 | 6/1989 |

(Continued)

OTHER PUBLICATIONS

Al-Aqeeli et al.: "Formation of an amorphous phase and its crystallization in the immiscible Nb—Zr system by mechanical alloying," Journal of Applied Physics 114, 153512, 2013.

(Continued)

*Primary Examiner* — Jessee R Roe
(74) *Attorney, Agent, or Firm* — KNOBBE, MARTENS, OLSON & BEAR, LLP

(57) ABSTRACT

Disclosed herein are embodiments of nickel-based alloys. The nickel-based alloys can be used as feedstock for PTA and laser cladding hardfacing processes, and can be manufactured into cored wires used to form hardfacing layers. The nickel-based alloys can have high corrosion resistance and large numbers of hard phases such as isolated hypereutectic hard phases.

20 Claims, 6 Drawing Sheets

(56) References Cited

U.S. PATENT DOCUMENTS 4,981,644 A 1/1991 Chang
5,094,812 A 3/1992 Dulmaine et al.
5,141,571 A * 8/1992 DuBois ..... B23K 35/3033 75/238
5,252,149 A 10/1993 Dolman
5,280,726 A 1/1994 Urbanic et al.
5,306,358 A 4/1994 Lai et al.
5,375,759 A 12/1994 Hiraishi et al.
5,424,101 A 6/1995 Atkins
5,495,837 A 3/1996 Mitsuhashi
5,567,251 A 10/1996 Peker et al.
5,570,636 A 11/1996 Lewis
5,618,451 A 4/1997 Ni
5,820,939 A 10/1998 Popoola et al.
5,837,326 A 11/1998 Dallaire
5,843,243 A 12/1998 Kawasaki et al.
5,858,558 A 1/1999 Zhao et al.
5,861,605 A 1/1999 Ogawa et al.
5,907,017 A 5/1999 Ober et al.
5,911,949 A 6/1999 Ninomiya et al.
5,935,350 A 8/1999 Raghu et al.
5,942,289 A 8/1999 Jackson
5,976,704 A 11/1999 McCune
5,988,302 A 11/1999 Sreshta et al.
6,071,324 A 6/2000 Laul et al.
6,117,493 A 9/2000 North
6,171,222 B1 1/2001 Lakeland et al.
6,210,635 B1 4/2001 Jackson et al.
6,232,000 B1 5/2001 Singh et al.
6,238,843 B1 5/2001 Ray
6,306,524 B1 10/2001 Spitsberg et al.
6,326,582 B1 12/2001 North
6,331,688 B1 12/2001 Hallén et al.
6,332,936 B1 12/2001 Hajaligo et al.
6,375,895 B1 4/2002 Daemen
6,398,103 B2 6/2002 Hasz et al.
6,441,334 B1 8/2002 Aida et al.
6,582,126 B2 6/2003 North
6,608,286 B2 8/2003 Jiang
6,669,790 B1 12/2003 Gundlach et al.
6,689,234 B2 2/2004 Branagan
6,702,905 B1 3/2004 Qiao et al.
6,702,906 B2 3/2004 Ogawa et al.
6,750,430 B2 6/2004 Kelly
7,052,561 B2 5/2006 Lu et al.
7,219,727 B2 5/2007 Slack et al.
7,285,151 B2 10/2007 Sjodin et al.
7,361,411 B2 4/2008 Daemen et al.
7,491,910 B2 2/2009 Kapoor et al.
7,507,305 B2 3/2009 Kawasaki et al.
7,553,382 B2 6/2009 Branagan et al.
7,569,286 B2 8/2009 Daemen et al.
7,754,152 B2 7/2010 Riebel et al.
7,776,451 B2 8/2010 Jiang et al.
7,935,198 B2 5/2011 Branagan et al.
8,070,894 B2 12/2011 Branagan
8,097,095 B2 1/2012 Branagan
8,153,935 B2 4/2012 Jang et al.
8,187,529 B2 5/2012 Powell
8,187,725 B2 5/2012 Kiser et al.
8,268,453 B2 9/2012 Dallaire
8,474,541 B2 7/2013 Branagan et al.
8,562,759 B2 10/2013 Cheney et al.
8,562,760 B2 10/2013 Cheney et al.
8,640,941 B2 2/2014 Cheney
8,647,449 B2 2/2014 Cheney et al.
8,658,934 B2 2/2014 Branagan et al.
8,662,143 B1 3/2014 Foster
8,669,491 B2 3/2014 Menon et al.
8,702,835 B2 4/2014 Yu et al.
8,703,046 B2 4/2014 Hanejko et al.
8,704,134 B2 4/2014 Branagan et al.
8,777,090 B2 7/2014 Miller et al.
8,801,872 B2 8/2014 Wright et al.
8,808,471 B2 8/2014 Wright et al.
8,858,675 B2 10/2014 Larsson
8,870,997 B2 10/2014 Klekovkin et al.
8,901,022 B2 12/2014 Francy et al.
8,911,662 B2 12/2014 Larsson
8,920,938 B2 12/2014 Hesse et al.
8,961,869 B2 2/2015 Kapoor et al.
8,973,806 B2 3/2015 Cheney
8,992,659 B2 3/2015 Larsson et al.
9,051,635 B2 6/2015 Jou
9,095,932 B2 8/2015 Miller et al.
9,145,598 B2 9/2015 Oshchepkov
9,174,293 B2 11/2015 Meyer
9,193,011 B2 11/2015 Mars et al.
9,233,419 B2 1/2016 Gries
9,255,309 B2 2/2016 Aimone
9,309,585 B2 4/2016 Cheney et al.
9,314,848 B2 4/2016 Larsson
9,340,855 B2 5/2016 Schade et al.
9,394,591 B2 7/2016 Deodeshmukh et al.
9,399,907 B2 7/2016 Mo et al.
9,469,890 B2 10/2016 Bengtsson
9,540,711 B2 1/2017 Fifield
9,580,773 B2 2/2017 Aimone et al.
9,631,262 B2 4/2017 Wright et al.
9,724,786 B2 8/2017 Postle et al.
9,725,793 B2 8/2017 Aimone et al.
9,738,959 B2 8/2017 Cheney et al.
9,745,648 B2 8/2017 Olserius et al.
9,802,387 B2 10/2017 Cheney
9,815,148 B2 11/2017 Postle
9,816,164 B2 11/2017 Larsson et al.
9,821,372 B2 11/2017 Gries
9,834,829 B1 12/2017 Aimone et al.
9,845,520 B2 12/2017 Wright et al.
9,856,546 B2 1/2018 Fischer et al.
9,869,132 B2 1/2018 Wyble et al.
9,879,333 B2 1/2018 Gerk et al.
9,908,816 B2 3/2018 Champion et al.
9,914,987 B2 3/2018 Snyder et al.
9,919,358 B2 3/2018 Gries
9,951,413 B2 4/2018 Billieres
9,957,590 B2 5/2018 Mars et al.
9,957,592 B2 5/2018 Aimone et al.
9,970,091 B2 5/2018 Crook et al.
9,994,935 B2 6/2018 Wolverton et al.
10,100,388 B2 10/2018 Cheney
10,105,796 B2 10/2018 Eibl
10,125,412 B2 11/2018 Kaner et al.
10,173,290 B2 1/2019 Cheney
10,252,919 B2 4/2019 Billieres et al.
10,329,647 B2 6/2019 Cheney
RE47,529 E 7/2019 Johnson
10,351,921 B2 7/2019 Snyder et al.
10,351,922 B2 7/2019 Snyder et al.
10,351,938 B2 7/2019 Schade et al.
10,358,699 B2 7/2019 Srivastava et al.
10,358,701 B2 7/2019 Reed et al.
10,370,740 B2 8/2019 Reed et al.
10,384,313 B2 8/2019 Persson
10,400,314 B2 9/2019 Aimone et al.
10,458,006 B2 10/2019 Bengtsson
10,465,267 B2 11/2019 Cheney
10,465,268 B2 11/2019 Bergman
10,465,269 B2 11/2019 Cheney
10,471,503 B2 11/2019 Wright et al.
10,513,758 B2 12/2019 Mars
10,519,529 B2 12/2019 Wright et al.
10,550,460 B2 2/2020 Nilsson et al.
10,577,680 B2 3/2020 Srivastava et al.
10,597,757 B2 3/2020 Gong et al.
10,702,918 B2 7/2020 Hu
10,702,924 B2 7/2020 Szabo et al.
10,711,329 B2 7/2020 Wright et al.
10,731,236 B2 8/2020 Kaner et al.
10,745,782 B2 8/2020 Wolverton et al.
10,851,444 B2 12/2020 Vecchio et al.
10,851,565 B1 12/2020 Krueger
10,872,682 B2 12/2020 Reed et al.
10,934,608 B2 3/2021 Gu

(56) References Cited

U.S. PATENT DOCUMENTS 10,941,473 B2 3/2021 Snyder
10,954,588 B2 3/2021 Cheney
11,001,912 B2 5/2021 Aimone et al.
11,033,998 B2 6/2021 Kavanaugh et al.
11,085,102 B2 8/2021 Cheney
11,111,912 B2 9/2021 Cheney
11,114,226 B2 9/2021 Jayaraman et al.
11,118,247 B2 9/2021 Gong et al.
11,124,429 B2 9/2021 Gore et al.
11,130,205 B2 9/2021 Cheney
11,174,538 B2 11/2021 Kaner et al.
2001/0019781 A1 9/2001 Hasz
2002/0041821 A1* 4/2002 Manning ..... C22C 19/056 420/446
2002/0054972 A1 5/2002 Charpentier et al.
2002/0060907 A1 5/2002 Saccomanno
2002/0098298 A1 7/2002 Bolton et al.
2002/0148533 A1 10/2002 Kim et al.
2002/0159914 A1 10/2002 Yeh
2003/0013171 A1 1/2003 Yang et al.
2004/0001966 A1 1/2004 Subramanian
2004/0062677 A1 4/2004 Chabenat et al.
2004/0079742 A1 4/2004 Kelly
2004/0115086 A1 6/2004 Chabenat et al.
2004/0206726 A1 10/2004 Daemen et al.
2005/0047952 A1 3/2005 Coleman
2005/0109431 A1 5/2005 Kernan et al.
2005/0139294 A1 6/2005 Kim et al.
2005/0164016 A1 7/2005 Branagan et al.
2006/0063020 A1 3/2006 Barbezat
2006/0093752 A1 5/2006 Darolia et al.
2006/0163217 A1 7/2006 Jiang
2006/0191606 A1 8/2006 Ogawa et al.
2006/0260583 A1 11/2006 Abi-Akar et al.
2007/0026159 A1 2/2007 Deem
2007/0029295 A1 2/2007 Branagan
2007/0090167 A1 4/2007 Arjakine et al.
2007/0125458 A1 6/2007 Kawasaki et al.
2007/0187369 A1 8/2007 Menon et al.
2007/0219053 A1 9/2007 Barufka et al.
2007/0253856 A1 11/2007 Vecchio et al.
2007/0284018 A1 12/2007 Hamano et al.
2008/0001115 A1 1/2008 Qiao et al.
2008/0031769 A1 2/2008 Yeh
2008/0083391 A1 4/2008 Sawada
2008/0149397 A1 6/2008 Overstreet
2008/0241580 A1 10/2008 Kiser et al.
2008/0241584 A1 10/2008 Daemen et al.
2008/0246523 A1 10/2008 Murakamo et al.
2008/0253918 A1 10/2008 Liang
2009/0017328 A1 1/2009 Katoh et al.
2009/0075057 A1 3/2009 Kulkarni
2009/0123765 A1 5/2009 Branagan
2009/0154183 A1 6/2009 Nagai et al.
2009/0252636 A1 10/2009 Christopherson, Jr. et al.
2009/0258250 A1 10/2009 Daemen et al.
2009/0285715 A1 11/2009 Arjakine et al.
2010/0009089 A1 1/2010 Junod et al.
2010/0028706 A1 2/2010 Hornschu et al.
2010/0044348 A1 2/2010 Buchmann
2010/0047622 A1 2/2010 Fischer et al.
2010/0055495 A1 3/2010 Sjodin
2010/0101780 A1 4/2010 Ballew et al.
2010/0132408 A1 6/2010 Billieres
2010/0136361 A1 6/2010 Osuki et al.
2010/0155236 A1 6/2010 Lee et al.
2010/0159136 A1 6/2010 Lee et al.
2010/0166594 A1 7/2010 Hirata et al.
2010/0189588 A1 7/2010 Kawatsu et al.
2010/0192476 A1 8/2010 Theisen et al.
2010/0258217 A1 10/2010 Kuehmann
2011/0004069 A1 1/2011 Ochs et al.
2011/0031222 A1 2/2011 Branagan et al.
2011/0048587 A1 3/2011 Vecchio et al.
2011/0064963 A1 3/2011 Cheney et al.
2011/0139761 A1 6/2011 Sugahara et al.
2011/0142713 A1 6/2011 Kawasaki et al.
2011/0162612 A1 7/2011 Qiao et al.
2011/0171485 A1 7/2011 Kawamoto et al.
2011/0220415 A1 9/2011 Jin et al.
2012/0055899 A1 3/2012 Parmaningsih
2012/0055903 A1 3/2012 Izutani et al.
2012/0100390 A1 4/2012 Kuroda
2012/0103456 A1 5/2012 Smith et al.
2012/0156020 A1 6/2012 Kottilingam et al.
2012/0160363 A1 6/2012 Jin et al.
2012/0258273 A1 10/2012 Churchill et al.
2012/0288400 A1 11/2012 Hirata et al.
2013/0039800 A1 2/2013 Dolman
2013/0094900 A1 4/2013 Folkmann et al.
2013/0108502 A1 5/2013 Bei
2013/0167965 A1 7/2013 Cheney et al.
2013/0171367 A1 7/2013 Kusinski et al.
2013/0174612 A1 7/2013 Linnot et al.
2013/0216722 A1 8/2013 Kusinski et al.
2013/0220523 A1 8/2013 Cheney
2013/0224516 A1 8/2013 Kusinski et al.
2013/0260177 A1 10/2013 Wallin et al.
2013/0266798 A1 10/2013 Cheney
2013/0266820 A1 10/2013 Kusinski et al.
2013/0294962 A1 11/2013 Wallin et al.
2014/0024509 A1 1/2014 Gerschefske
2014/0044587 A1 2/2014 Crook et al.
2014/0044617 A1 2/2014 Dreisinger
2014/0060707 A1 3/2014 Wright et al.
2014/0066851 A1 3/2014 Cheney, II
2014/0116575 A1 5/2014 Cheney et al.
2014/0131338 A1 5/2014 Postle
2014/0190594 A1 7/2014 Branagan et al.
2014/0219859 A1 8/2014 Cheney
2014/0234154 A1 8/2014 Cheney et al.
2014/0248509 A1 9/2014 Cheney et al.
2014/0263248 A1 9/2014 Postle
2014/0272388 A1 9/2014 Knight et al.
2014/0295194 A1 10/2014 Yoshitaka et al.
2014/0322064 A1 10/2014 Gerk et al.
2014/0356223 A1 12/2014 Nilsson et al.
2015/0004337 A1 1/2015 Zimmermann et al.
2015/0075681 A1 3/2015 Wright et al.
2015/0086413 A1 3/2015 Wolverton et al.
2015/0106035 A1 4/2015 Vecchio et al.
2015/0114525 A1 4/2015 Valls Anglés
2015/0118098 A1 4/2015 Valls
2015/0122552 A1 5/2015 Wang et al.
2015/0152994 A1 6/2015 Bondil et al.
2015/0252631 A1 9/2015 Miller
2015/0275341 A1 10/2015 Cheney
2015/0284817 A1 10/2015 Snyder et al.
2015/0284829 A1 10/2015 Cheney
2015/0307968 A1 10/2015 Mars et al.
2015/0328680 A1 11/2015 Tuffile
2015/0367454 A1 12/2015 Cheney
2016/0001368 A1 1/2016 Gries et al.
2016/0002752 A1 1/2016 Srivastava et al.
2016/0002764 A1 1/2016 Gries et al.
2016/0017463 A1 1/2016 Cheney
2016/0024628 A1 1/2016 Cheney
2016/0040262 A1 2/2016 Snyder et al.
2016/0083830 A1 3/2016 Cheney
2016/0114392 A1 4/2016 Berg et al.
2016/0138144 A1 5/2016 Olsérius
2016/0144463 A1 5/2016 Hellsten et al.
2016/0195216 A1 7/2016 Bondil et al.
2016/0201169 A1 7/2016 Vecchio
2016/0201170 A1 7/2016 Vecchio
2016/0215374 A1 7/2016 Schade et al.
2016/0222490 A1 8/2016 Wright et al.
2016/0243616 A1 8/2016 Gries
2016/0258044 A1 9/2016 Litström et al.
2016/0271736 A1 9/2016 Han et al.
2016/0289001 A1 10/2016 Shibata et al.
2016/0289798 A1 10/2016 Deodeshmukh et al.
2016/0289799 A1 10/2016 Crook et al.
2016/0289803 A1 10/2016 Cheney

(56) References Cited

U.S. PATENT DOCUMENTS

| | | | |
|---|---|---|---|
| 2016/0329139 | A1 | 11/2016 | Jayaraman |
| 2016/0376686 | A1 | 12/2016 | Jou |
| 2017/0009324 | A1 | 1/2017 | Crook et al. |
| 2017/0014865 | A1 | 1/2017 | Kusinski et al. |
| 2017/0022588 | A1 | 1/2017 | Tang et al. |
| 2017/0044646 | A1 | 2/2017 | Gong et al. |
| 2017/0145547 | A1 | 5/2017 | Saal et al. |
| 2017/0253950 | A1 | 9/2017 | Shinohara |
| 2017/0275740 | A1 | 9/2017 | Bergman |
| 2017/0275748 | A1 | 9/2017 | Cheney et al. |
| 2018/0016664 | A1 | 1/2018 | Hu |
| 2018/0021894 | A1 | 1/2018 | Persoon et al. |
| 2018/0066343 | A1 | 3/2018 | Bengtsson |
| 2018/0066345 | A1 | 3/2018 | Cheney et al. |
| 2018/0094343 | A1 | 4/2018 | Gerk et al. |
| 2018/0099877 | A1 | 4/2018 | Chang et al. |
| 2018/0135143 | A1 | 5/2018 | Snyder et al. |
| 2018/0195156 | A1 | 7/2018 | Reed et al. |
| 2018/0216212 | A1 | 8/2018 | Reed et al. |
| 2018/0230016 | A1 | 8/2018 | Kaner et al. |
| 2018/0230578 | A1 | 8/2018 | Srivastava et al. |
| 2018/0245190 | A1 | 8/2018 | Snyder et al. |
| 2018/0265949 | A1 | 9/2018 | Wolverton et al. |
| 2018/0272423 | A1 | 9/2018 | Hu |
| 2019/0017154 | A1 | 1/2019 | Kaner et al. |
| 2019/0024217 | A1 | 1/2019 | Yolton |
| 2019/0071318 | A1 | 3/2019 | Kaner et al. |
| 2019/0084039 | A1 | 3/2019 | Hu |
| 2019/0135646 | A1 | 5/2019 | Turner et al. |
| 2019/0160603 | A1 | 5/2019 | Eibl |
| 2019/0177820 | A1 | 6/2019 | Larsson |
| 2019/0300374 | A1 | 10/2019 | Shevchenko et al. |
| 2019/0309399 | A1 | 10/2019 | Badwe |
| 2019/0323107 | A1 | 10/2019 | Srivastava et al. |
| 2019/0368014 | A1 | 12/2019 | Liimatainen |
| 2019/0376165 | A1 | 12/2019 | Wen |
| 2020/0001367 | A1 | 1/2020 | Duffy et al. |
| 2020/0005975 | A1 | 1/2020 | Jayaraman et al. |
| 2020/0048743 | A1 | 2/2020 | Gong et al. |
| 2020/0063238 | A1 | 2/2020 | Yolton |
| 2020/0063239 | A1 | 2/2020 | Xu et al. |
| 2020/0078860 | A1 | 3/2020 | Wright et al. |
| 2020/0109465 | A1 | 4/2020 | Cao et al. |
| 2020/0149141 | A1 | 5/2020 | Wu et al. |
| 2020/0172998 | A1 | 6/2020 | Crudden et al. |
| 2020/0189918 | A1 | 6/2020 | Saeuberlich et al. |
| 2020/0223007 | A1 | 7/2020 | Keegan et al. |
| 2020/0308679 | A1 | 10/2020 | Nymann |
| 2020/0316718 | A1 | 10/2020 | Smathers |
| 2020/0325561 | A1 | 10/2020 | Kaner |
| 2020/0370149 | A1 | 11/2020 | Gong |
| 2020/0385845 | A1 | 12/2020 | Gong |
| 2021/0040585 | A1 | 2/2021 | Alabort |
| 2021/0046543 | A1 | 2/2021 | Larsson |
| 2021/0062305 | A1 | 3/2021 | Fang |
| 2021/0147967 | A1 | 5/2021 | Cao et al. |
| 2021/0164081 | A1 | 6/2021 | Eibl |
| 2021/0180157 | A1 | 6/2021 | Bracci |
| 2021/0180162 | A1 | 6/2021 | Vecchio |
| 2021/0180170 | A1 | 6/2021 | Pike |
| 2021/0197524 | A1 | 7/2021 | Maroli et al. |
| 2021/0222275 | A1 | 7/2021 | Saboo et al. |
| 2021/0246537 | A1 | 8/2021 | Maroli et al. |
| 2021/0254202 | A1 | 8/2021 | Gong et al. |
| 2021/0262050 | A1 | 8/2021 | Oshchepkov et al. |
| 2021/0286079 | A1 | 9/2021 | Vecchio |
| 2021/0310106 | A1 | 10/2021 | Wei et al. |
| 2021/0324498 | A1 | 10/2021 | Hericher et al. |
| 2021/0332465 | A1 | 10/2021 | Behera et al. |
| 2021/0387920 | A1 | 12/2021 | Bouttes et al. |

FOREIGN PATENT DOCUMENTS

| | | | | |
|---|---|---|---|---|
| CN | 1225629 | C | 11/2005 | |
| CN | 101016603 | | 8/2007 | |
| CN | 101368239 | | 2/2009 | |
| CN | 101948994 | | 1/2011 | |
| CN | 101994076 | | 3/2011 | |
| CN | 102233490 | A | 11/2011 | |
| CN | 102286702 | | 12/2011 | |
| CN | 102357750 | A | 2/2012 | |
| CN | 102936724 | | 2/2013 | |
| CN | 103628017 | | 3/2014 | |
| CN | 104093510 | | 10/2014 | |
| CN | 104625473 | | 5/2015 | |
| CN | 104694840 | | 6/2015 | |
| CN | 104805391 | | 7/2015 | |
| CN | 106119838 | | 11/2016 | |
| CN | 108607983 | | 10/2018 | |
| DE | 27 54 437 | | 7/1979 | |
| DE | 33 20 513 | | 12/1983 | |
| DE | 42 02 828 | | 8/1993 | |
| DE | 4411296 | | 7/1995 | |
| DE | 10 320 397 | A1 | 12/2004 | |
| DE | 10329912 | | 6/2005 | |
| EP | 0 057 242 | | 8/1982 | |
| EP | 0 346 293 | | 12/1989 | |
| EP | 0 365 884 | | 5/1990 | |
| EP | 0 774 528 | | 5/1997 | |
| EP | 0 740 591 | | 3/1999 | |
| EP | 1004684 | A1 * | 5/2000 | ..... B23K 35/304 |
| EP | 0 939 139 | | 10/2001 | |
| EP | 1 270 755 | | 1/2003 | |
| EP | 1 279 748 | | 1/2003 | |
| EP | 1 279 749 | | 1/2003 | |
| EP | 1 120 472 | | 7/2003 | |
| EP | 1 361 288 | | 9/2006 | |
| EP | 1 721 999 | | 11/2006 | |
| EP | 1 857 204 | | 11/2007 | |
| EP | 1 694 876 | | 1/2008 | |
| EP | 2 050 533 | | 4/2009 | |
| EP | 2 305 415 | | 4/2011 | |
| EP | 2 388 345 | | 11/2011 | |
| EP | 2 628 825 | | 8/2013 | |
| EP | 2 639 323 | | 9/2013 | |
| EP | 2 660 342 | | 11/2013 | |
| EP | 2 072 627 | | 4/2014 | |
| EP | 2 730 355 | | 5/2014 | |
| EP | 2 743 361 | | 6/2014 | |
| EP | 2 104 753 | | 7/2014 | |
| EP | 2 777 869 | | 9/2014 | |
| EP | 2 778 247 | | 9/2014 | |
| EP | 2 873 747 | | 5/2015 | |
| EP | 2 563 942 | | 10/2015 | |
| EP | 2 064 359 | | 4/2016 | |
| EP | 3 034 211 | | 6/2016 | |
| EP | 2 235 225 | | 10/2016 | |
| EP | 3 093 858 | | 11/2016 | |
| EP | 2 659 014 | | 4/2017 | |
| EP | 3 156 155 | | 4/2017 | |
| EP | 2 147 445 | | 5/2017 | |
| EP | 2 252 419 | | 6/2017 | |
| EP | 2 265 559 | | 6/2017 | |
| EP | 2 329 507 | | 6/2017 | |
| EP | 2 285 996 | | 8/2017 | |
| EP | 3 211 108 | | 8/2017 | |
| EP | 1 700 319 | | 10/2017 | |
| EP | 2 207 907 | | 12/2017 | |
| EP | 2 788 136 | | 1/2018 | |
| EP | 2 414 554 | B1 | 2/2018 | |
| EP | 3 145 660 | | 4/2018 | |
| EP | 2 432 908 | B1 | 5/2018 | |
| EP | 2 181 199 | | 8/2018 | |
| EP | 2 477 784 | | 8/2018 | |
| EP | 2 695 171 | | 8/2018 | |
| EP | 3 354 758 | | 8/2018 | |
| EP | 1 799 380 | | 9/2018 | |
| EP | 3 034 637 | B1 | 10/2018 | |
| EP | 3 266 892 | | 10/2018 | |
| EP | 3 444 452 | | 2/2019 | |
| EP | 2 265 739 | | 6/2019 | |
| EP | 3 259 095 | | 6/2019 | |
| EP | 1 844 172 | | 7/2019 | |
| EP | 3 517 642 | | 7/2019 | |

(56) References Cited

FOREIGN PATENT DOCUMENTS

| | | | |
|---|---|---|---|
| EP | 3 115 472 | | 10/2019 |
| EP | 2 155 921 | | 11/2019 |
| EP | 3 350 354 | | 2/2020 |
| EP | 3 354 764 | | 3/2020 |
| EP | 3 149 216 | | 4/2020 |
| EP | 2 403 966 | B1 | 5/2020 |
| EP | 3 362 210 | | 5/2020 |
| EP | 3 134 558 | | 7/2020 |
| EP | 3 514 253 | | 10/2020 |
| EP | 3 333 275 | | 11/2020 |
| EP | 3 653 736 | | 12/2020 |
| EP | 3 411 169 | | 1/2021 |
| EP | 3 590 642 | | 1/2021 |
| EP | 3 590 643 | | 1/2021 |
| EP | 1 848 836 | B1 | 4/2021 |
| EP | 3 822 007 | | 5/2021 |
| EP | 2 671 669 | | 6/2021 |
| FR | 2055735 | | 4/1971 |
| FR | 2218797 | | 9/1974 |
| GB | 465999 | | 5/1937 |
| GB | 956740 | | 4/1964 |
| GB | 1073621 | | 6/1967 |
| GB | 2153846 | A | 8/1985 |
| GB | 2273109 | | 6/1994 |
| GB | 2579580 | | 7/2020 |
| GB | 2567492 | | 9/2020 |
| GB | 2584654 | | 12/2020 |
| GB | 2584905 | | 12/2020 |
| IN | MUMNP-2003-00842 | | 4/2005 |
| JP | 43-019745 | | 8/1968 |
| JP | 45-026214 | | 10/1970 |
| JP | 47-1685 | | 1/1972 |
| JP | 49-056839 | | 6/1974 |
| JP | 51-061424 | | 5/1976 |
| JP | 55-122848 | | 9/1980 |
| JP | 58-132393 | | 8/1983 |
| JP | 59-016952 | | 1/1984 |
| JP | 60-133996 | | 7/1985 |
| JP | 6031897 | B1 | 7/1985 |
| JP | 61-283489 | | 12/1986 |
| JP | 63-026205 | | 2/1988 |
| JP | 63-42357 | | 2/1988 |
| JP | 63-65056 | | 3/1988 |
| JP | 63-089643 | | 4/1988 |
| JP | 01-177330 | | 7/1989 |
| JP | 03-133593 | | 6/1991 |
| JP | 03-248799 | | 11/1991 |
| JP | 04-237592 | | 8/1992 |
| JP | 04-358046 | | 12/1992 |
| JP | 05-171340 | | 7/1993 |
| JP | 07-179997 | | 7/1995 |
| JP | 07-268524 | | 10/1995 |
| JP | 08-134570 | | 5/1996 |
| JP | 09-95755 | | 4/1997 |
| JP | 2001-066130 | | 3/2001 |
| JP | 2001-303233 | | 10/2001 |
| JP | 2002-241919 | | 8/2002 |
| JP | 2003-205352 | | 7/2003 |
| JP | 2004-149924 | | 5/2004 |
| JP | 2005-042152 | | 2/2005 |
| JP | 2005-290406 | | 10/2005 |
| JP | 2007-154284 | | 6/2007 |
| JP | 2008-261329 | | 10/2008 |
| JP | 2010-138440 | | 6/2010 |
| JP | 2010-138491 | | 6/2010 |
| JP | 2012-000616 | | 1/2012 |
| JP | 2014-047388 | | 3/2014 |
| JP | 2015-083715 | | 4/2015 |
| JP | 2015-526596 | | 9/2015 |
| JP | 2018-131667 | | 8/2018 |
| KR | 10-0935816 | B1 | 1/2010 |
| SU | 1706398 | | 1/1992 |
| TW | 200806801 | A | 2/2008 |
| WO | WO 84/000385 | | 2/1984 |
| WO | WO 84/004760 | | 12/1984 |
| WO | WO 95/004628 | | 2/1995 |
| WO | WO 03/018856 | | 3/2003 |
| WO | WO 06/080978 | | 8/2006 |
| WO | WO 06/086350 | | 8/2006 |
| WO | WO 07/120194 | | 10/2007 |
| WO | WO 08/042330 | | 4/2008 |
| WO | WO 08/060226 | | 5/2008 |
| WO | WO 08/082353 | | 7/2008 |
| WO | WO 08/105788 | | 9/2008 |
| WO | WO 08/153499 | | 12/2008 |
| WO | WO 09/085000 | | 7/2009 |
| WO | WO 10/044740 | | 4/2010 |
| WO | WO 10/046224 | | 4/2010 |
| WO | WO 10/074634 | | 7/2010 |
| WO | WO 10/134886 | | 11/2010 |
| WO | WO 11/005403 | | 1/2011 |
| WO | WO 11/021751 | | 2/2011 |
| WO | WO 11/071054 | | 6/2011 |
| WO | WO 11/084213 | | 7/2011 |
| WO | WO 11/091479 | | 8/2011 |
| WO | WO 11/152774 | | 12/2011 |
| WO | WO 11/158706 | | 12/2011 |
| WO | WO 12/021186 | | 2/2012 |
| WO | WO 12/022874 | | 2/2012 |
| WO | WO 12/112844 | | 8/2012 |
| WO | WO 12/162226 | | 11/2012 |
| WO | WO 13/049056 | | 4/2013 |
| WO | WO 13/055652 | | 4/2013 |
| WO | WO 13/060839 | | 5/2013 |
| WO | WO 13/102650 | | 7/2013 |
| WO | WO 13/126134 | | 8/2013 |
| WO | WO 13/152306 | | 10/2013 |
| WO | WO 13/167580 | | 11/2013 |
| WO | WO 13/167628 | | 11/2013 |
| WO | WO 13/185174 | | 12/2013 |
| WO | WO 14/001544 | | 1/2014 |
| WO | WO 14/023646 | | 2/2014 |
| WO | WO 14/070006 | | 5/2014 |
| WO | WO 14/081491 | | 5/2014 |
| WO | WO 14/083544 | | 6/2014 |
| WO | WO 14/085319 | | 6/2014 |
| WO | WO 14/090922 | | 6/2014 |
| WO | WO 14/114714 | | 7/2014 |
| WO | WO 14/114715 | | 7/2014 |
| WO | WO 14/187867 | | 11/2014 |
| WO | WO 14/197088 | | 12/2014 |
| WO | WO 14/201239 | | 12/2014 |
| WO | WO 14/202488 | | 12/2014 |
| WO | WO 15/028358 | | 3/2015 |
| WO | WO 15/049309 | | 4/2015 |
| WO | WO 15/075122 | | 5/2015 |
| WO | WO 15/183955 | | 12/2015 |
| WO | WO 16/003520 | | 1/2016 |
| WO | WO 16/010599 | | 1/2016 |
| WO | WO 16/041977 | | 3/2016 |
| WO | WO 16/099390 | | 6/2016 |
| WO | WO 16/124532 | | 8/2016 |
| WO | WO 16/131702 | | 8/2016 |
| WO | WO 17/041006 | | 3/2017 |
| WO | WO 17/046517 | | 3/2017 |
| WO | WO 17/059026 | | 4/2017 |
| WO | WO 17/063923 | | 4/2017 |
| WO | WO 17/091743 | | 6/2017 |
| WO | WO 17/132286 | | 8/2017 |
| WO | WO 17/132322 | | 8/2017 |
| WO | WO 17/134039 | | 8/2017 |
| WO | WO 17/157835 | | 9/2017 |
| WO | WO 17/162499 | | 9/2017 |
| WO | WO 17/186468 | | 11/2017 |
| WO | WO 17/200797 | | 11/2017 |
| WO | WO 18/015547 | | 1/2018 |
| WO | WO 18/021409 | | 2/2018 |
| WO | WO 18/050474 | | 3/2018 |
| WO | WO 18/065614 | | 4/2018 |
| WO | WO 18/04179 | | 6/2018 |
| WO | WO 18/106978 | | 6/2018 |
| WO | WO 18/114845 | | 6/2018 |
| WO | WO 18/138247 | | 8/2018 |
| WO | WO 18/138270 | | 8/2018 |

(56) References Cited

FOREIGN PATENT DOCUMENTS

| | | |
|---|---|---|
| WO | WO 18/145032 | 8/2018 |
| WO | WO 18/158509 | 9/2018 |
| WO | WO 18/232618 | 12/2018 |
| WO | WO 18/232619 | 12/2018 |
| WO | WO 19/021015 | 1/2019 |
| WO | WO 19/043219 | 3/2019 |
| WO | WO 19/047587 | 3/2019 |
| WO | WO 19/094506 | 5/2019 |
| WO | WO 19/108596 | 6/2019 |
| WO | WO 19/125637 | 6/2019 |
| WO | WO 19/145196 | 8/2019 |
| WO | WO 19/166749 | 9/2019 |
| WO | WO 19/194869 | 10/2019 |
| WO | WO 19/197376 | 10/2019 |
| WO | WO 19/215450 | 11/2019 |
| WO | WO 20/007652 | 1/2020 |
| WO | WO 20/007654 | 1/2020 |
| WO | WO 20/043718 | 3/2020 |
| WO | WO 20/053518 | 3/2020 |
| WO | WO 20/065296 | 4/2020 |
| WO | WO 20/065297 | 4/2020 |
| WO | WO 20/074241 | 4/2020 |
| WO | WO 20/115478 | 6/2020 |
| WO | WO 20/120563 | 6/2020 |
| WO | WO 20/178145 | 9/2020 |
| WO | WO 20/185641 | 9/2020 |
| WO | WO 20/201437 | 10/2020 |
| WO | WO 20/201438 | 10/2020 |
| WO | WO 21/089851 | 5/2021 |
| WO | WO 21/217512 | 11/2021 |
| WO | WO 21/219564 | 11/2021 |
| WO | WO 21/231285 | 11/2021 |

OTHER PUBLICATIONS

Audouard, et al., Mar. 26-31, 2000, Corrosion Performance and Field Experience With Super Duplex and Super Austenitic Stainless Steels in FGD Systems, Corrosion 2000, 8 pp.

Azo Materials, "Stainless Steel—Grade 420," Oct. 23, 2001, <https://www.azom.com/article.aspx?ArticleID=972>, accessed Aug. 15, 2017.

Branagan, et al.: Developing extreme hardness (>15GPa) in iron based nanocomosites, Composites Part A: Applied Science and Manufacturing, Elsevier Science Publishers B.V., Amsterdam, NL, vol. 33, No. 6, Jun. 1, 2002, pp. 855-859.

Chen et al.: "Characterization of Microstructure and Mechanical Properties of High Chromium Cast Irons Using SEM and Nanoindentation," JMEPEG 2015 (published online Oct. 30, 2014), vol. 24(1), pp. 98-105.

Cheney, et al.: "Development of quaternary Fe-based bulk metallic glasses," Materials Science and Engineering, vol. 492, No. 1-2, Sep. 25, 2008, pp. 230-235.

Cheney: Modeling the Glass Forming Ability of Metals. A Dissertation submitted in partial satisfaction of the Requirements for the degree of Doctor of Philosophy. University of California, San Diego. Dec. 2007.

C—Mo Phase Diagram [online], [retrieved on Jan. 27, 2015]. Retrieved from the Internet: <URL:http://factsage.cn/fact/documentation/SGTE/C-Mo.jpg.

C—Nb Phase Diagram [online], [retrieved on Jan. 27, 2015]. Retrieved from the Internet: <URL:http://www.crct.polymtl.ca/fact/documentation/BINARY/C-Nb.jpg.

Cr—C Phase Diagram [online], [retrieved on Jan. 27, 2015]. Retrieved from the Internet: http://www.azom.com/work/3ud2quvLOU9g4VBMjVEh_files/image002.gif.

Crucible Industries LLC, Jun. 3, 2010, Crucible CPM S90V® data sheet, retrieved from the internet Mar. 14, 2019, https://www.crucible.com/PDFs/DataSheets2010/dsS90v1%202010.pdf, 2 pp.

Davis, Jr, ed. Dec. 1994, Stainless steels. ASM International, Materials Park, OH, p. 447.

Fujiki et al., 1988, The sintering phenomena and heat-treated properties of carbides and borides precipitated p/m alloys made of H.S.S. powder, Japan Society of Powder and Powder Metallurgy, 35(3):119-123.

Gorni, Oct. 9, 2003, Austenite transformation temperatures: ferrite start and finish, in Steel Forming and Heath Treating Handbook, pp. 26-43.

Iron-Carbon (Fe—C) Phase diagram [online], [retrieved on Jan. 27, 2014]. Retrieved from the internet: <URL:http://www.calphad.com/iron-carbon.html>.

Khalifa, et al.: "Effect of Mo—Fe substitution on glass forming ability, thermal stability, and hardness of Fe—C—B—Mo—Cr—W bulk amorphous allows," Materials Science and Engineering, vol. 490, No. 1-2, Aug. 25, 2008, pp. 221-228.

Kumashiro et al., May 31, 1980, The vickers micro-hardness of nonstoichiometric niobium carbide and vanadium carbide single crystals up to 1500c, Journal of Materials Science, 15(5):1321-1324.

Kushner et al., 1992, Thermal Spray Coatings, in Blau (ed) ASM Handbook, vol. 18, Friction, Lubrication, and Wear Technolgoy, pp. 829-833.

Li et al., Feb. 28, 2000, Temperature dependence of the hardness of single-phase cementite films prepared by an electron-shower PVD method, Journal of the Japan Institute of Metals and Materials, 64(2):134-140.

Liu et al., Jan. 14, 2000, Measurement of austenite-to-ferrite transformation temperature after multi-pass deformation of steels, Materials Science and Engineering A, 194(1):L15-L18.

Miracle, D.B.: The efficient cluster packing model—An atomic structural model for metallic glasses, Acta Materialia vol. 54, Issue 16, Sep. 2006, pp. 4317-4336.

Miyoshi et al., Apr. 25, 1965, High temperature hardness of WC, TiC, TaC, NbC and their mixed carbides, Journal of the Japan Society of Powder and Powder Metalurgy, 12(2):78-84.

Ohmura, Dec. 2003, Evaluation of temper softening behavior of Fe—C binary martensitic steels by nanoindentation, Scripta Materialia, 49(12):1157-1162.

Senkov et al., Jun. 23, 2010, Refractory high-entropy alloys, Intermetallics, 18:1758-1765.

Teng: "Processing, Microstructures, and Properties of Aluminide-Strengthened Ferritic Steels," The University of Tennessee, Knoxville, Dec. 2011.

Tillack, et al.: "Selection of Nickel, Nickel-Copper, Nickel-Cromium, and Nickel-Chromium-Iron Allows", ASM Handbook, Welding, Brazing and Soldering, vol. 6, Dec. 1, 1993 (Dec. 1, 1993) pp. 586-592, XP008097120, p. 589.

Titanium-Boron (TiB) Phase Diagram [online], [retrieved on Jan. 27, 2015]. Retrieved from the internet:<URL:http://www.calphad.com/titaniumboron.html>.

Tucker , 2013, Introduction to Thermal Spray Technology, ASM Handbook, vol. 5A, pp. 3-9.

Wang et al., Jul. 2014, Effect of molybdenum, manganese and tungsten contents on the corrosion behavior and hardness of iron-based metallic glasses, Materials and Corrosion, 65(7):733-741.

Wank et al., 2007, Behavior of thermally sprayed wear protective coatings exposed to different abrasive wear conditions in comparison to hard chromium platings, 7 pp.

Yamamoto et al., 2014, Influence of Mo and W on high temperature hardness of M7C3 carbide in high chromium white cast iron, Materials Transactions, 55(4):684-689.

Yano et al., Apr. 2011, Modification of NiAl intermetallic coatings processed by PTA with chromium carbides, ASTM International Journal, 8(4):190-204.

Yoo et al., Jun. 2006, The effect of boron on the wear behavior of iron-based hardfacing alloys for nuclear power plants valves, Journal of Nuclear Materials, 352:90-96.

Zhu et al., 2017, Microstructure and sliding wear performance of Cr7C3—(Ni,Cr)3(Al,Cr) coating deposited from Cr7C3 in situ formed atomized powder, J. Therm Spray Tech, 26:254-264.

International Search Report and Written Opinion re PCT Application No. PCT/US2019/048080, dated Jan. 24, 2020.

* cited by examiner

CORROSION AND WEAR RESISTANT NICKEL BASED ALLOYS

INCORPORATION BY REFERENCE TO ANY PRIORITY APPLICATIONS

This application claims the benefit of priority from PCT App. No. PCT/US2019/058080, filed Oct. 25, 2019, and entitled "CORROSION AND WEAR RESISTANT NICKEL BASED ALLOYS", which claims the benefit of priority from U.S. App. No. 62/751,020, filed Oct. 26, 2018, and entitled "CORROSION AND WEAR RESISTANT NICKEL BASED ALLOYS", the entirety of which are incorporated by reference herein.

BACKGROUND

Field

Embodiments of this disclosure generally relate to nickel-based alloys that can serve as effective feedstock for hardfacing processes, such as for plasma transferred arc (PTA), laser cladding hardfacing processes including high speed laser cladding, and thermal spray processes such as high velocity oxygen fuel (HVOF) thermal spray.

Description of the Related Art

Abrasive and erosive wear is a major concern for operators in applications that involve sand, rock, or other hard media wearing away against a surface. Applications which see severe wear typically utilize materials of high hardness to resist material failure due to the severe wear. These materials typically contain carbides and/or borides as hard precipitates which resist abrasion and increase the bulk hardness of the material. These materials are often applied as a coating, known as hardfacing, through various welding processes or cast directly into a part.

Another major concern for operators is corrosion. Applications that see severe corrosion typically utilize soft nickel based or stainless steel type materials with high chromium. In these types of applications, no cracks can be present in the overlay as this will result in corrosion of the underlying base material.

Currently, it is common to use either the wear resistant material, or the corrosion resistant material, as there are few alloys that satisfy both requirements. Often the current materials do not provide the necessary lifetime or require the addition of carbides for the increase in wear resistance, which may cause cracking.

SUMMARY

Disclosed herein are embodiments of a feedstock material comprising, in wt. %, Ni, C: 0.5-2, Cr: 10-30, Mo: 5.81-18.2, Nb+Ti: 2.38-10.

In some embodiments, the feedstock material may further comprise, in wt. %, C: about 0.8-about 1.6, Cr: about 14-about 26, and Mo: about 8-about 16. In some embodiments, the feedstock material may further comprise, in wt. %, C: about 0.84-about 1.56, Cr: about 14-about 26, Mo: about 8.4-about 15.6, and Nb+Ti: about 4.2-about 8.5. In some embodiments, the feedstock material may further comprise, in wt. %, C: about 8.4-about 1.56, Cr: about 14-about 26, Mo: about 8.4-about 15.6, Nb: about 4.2-about 7.8, and Ti: about 0.35-about 0.65. In some embodiments, the feedstock material may further comprise, in wt. %, C: about 1.08-about 1.32, Cr: about 13-about 22, Mo: about 10.8-about 13.2, and Nb: about 5.4-about 6.6. In some embodiments, the feedstock material may further comprise, in wt. %, C: about 1.2, Cr: about 20, Mo: about 12, Nb: about 6, and Ti: about 0.5.

In some embodiments, the feedstock material is a powder. In some embodiments, the feedstock material is a wire. In some embodiments, the feedstock material is a combination of a wire and a powder.

Also disclosed herein are embodiments of a hardfacing layer formed from the feedstock material as disclosed herein.

In some embodiments, the hardfacing layer can comprise a nickel matrix comprising hard phases of 1,000 Vickers hardness or greater totaling 5 mol. % or greater, 20 wt. % or greater of a combined total of chromium and molybdenum, isolated hypereutectic hard phases totaling to 50 mol. % or more of a total hard phase fraction, a $WC/Cr_3C_2$ ratio of 0.33 to 3, an ASTM G65A abrasion loss of less than 250 $mm^3$, and a hardness of 650 Vickers or greater.

In some embodiments, the hardfacing layer can have a hardness of 750 Vickers or greater. In some embodiments, the hardfacing layer can exhibit two cracks or fewer per square inch, have an adhesion of 9,000 psi or greater, and have a porosity of 2 volume % or less. In some embodiments, the hardfacing layer can have a porosity of 0.5 volume % or less. In some embodiments, the hardfacing layer can have a corrosion rate of 1 mpy or less in a 28% $CaCl_2$) electrolyte, pH=9.5 environment. In some embodiments, the hardfacing layer can have a corrosion rate of 0.4 mpy or less in a 28% $CaCl_2$) electrolyte, pH=9.5 environment. In some embodiments, the hardfacing layer can have a corrosion rate of below 0.1 mpy in a 3.5% sodium chloride solution for 16 hours according to G-59/G-61. In some embodiments, the hardfacing layer can have a corrosion rate of below 0.08 mpy in a 3.5% sodium chloride solution for 16 hours according to G-59/G-61.

In some embodiments, the nickel matrix can have a matrix proximity of 80% or greater as compared to a corrosion resistant alloy defined by Ni: BAL, X >20 wt. %, wherein X represents at least one of Cu, Cr, or Mo. In some embodiments, the corrosion resistant alloy is selected from the group consisting of Inconel 625, Inconel 622, Hastelloy C276, Hastelloy X, and Monel 400.

In some embodiments, the hardfacing layer can be applied onto a hydraulic cylinder, tension riser, mud motor rotor, or oilfield component application.

Further disclosed herein are embodiments of a feedstock material comprising nickel; wherein the feedstock material is configured to form a corrosion resistant matrix which is characterized by having, under thermodynamic equilibrium conditions hard phases of 1,000 Vickers hardness or greater totaling 5 mol. % or greater, and a matrix proximity of 80% or greater when compared to a known corrosion resistant nickel alloy.

In some embodiments, the known corrosion resistant nickel alloy can be represented by the formula Ni: BAL X >20 wt. %, wherein X represents at least one of Cu, Cr, or Mo.

In some embodiments, the feedstock material can be a powder. In some embodiments, the powder can be made via an atomization process. In some embodiments, the powder can be made via an agglomerated and sintered process.

In some embodiments, the corrosion resistant matrix can be a nickel matrix comprising 20 wt. % or greater of a combined total of chromium and molybdenum. In some embodiments, under thermodynamic equilibrium conditions, the corrosion resistant matrix can be characterized by having isolated hypereutectic hard phases totaling to 50 mol. % or more of a total hard phase fraction.

In some embodiments, the known corrosion resistant nickel alloy can be selected from the group consisting of Inconel 625, Inconel 622, Hastelloy C276, Hastelloy X, and Monel 400.

In some embodiments, the feedstock material can comprise C: 0.84-1.56, Cr: 14-26, Mo: 8.4-15.6, Nb: 4.2-7.8, and Ti: 0.35-0.65. In some embodiments, the feedstock material can further comprise B: about 2.5 to about 5.7, and Cu: about 9.8 to about 23. In some embodiments, the feedstock material can further comprise Cr: about 7 to about 14.5.

In some embodiments, under thermodynamic equilibrium conditions, the corrosion resistant matrix can be characterized by having hard phases totaling 50 mol. % or greater, and a liquidus temperature of 1550 K or lower.

In some embodiments, the feedstock material can comprise a blend of Monel and at least one of WC or $Cr_3C_2$.

In some embodiments, the feedstock material is selected from the group consisting of, by wt. 75-85% WC+15-25% Monel, 65-75% WC+25-35% Monel, 60-75% WC+25-40% Monel, 75-85% $Cr_3C_2$+15-25% Monel, 65-75% $Cr_3C_2$+25-35% Monel, 60-75% $Cr_3C_2$+25-40% Monel, 75-85% WC/$Cr_3C_2$+15-25% Monel, 65-75% WC/$Cr_3C_2$+25-35% Monel, and 60-75% WC/$Cr_3C_2$+25-40% Monel.

In some embodiments, a WC/$Cr_3C_2$ ratio of the corrosion resistant matrix can be 0.25 to 5 by volume. In some embodiments, the thermal spray feedstock material can comprise a wire. In some embodiments, the thermal spray feedstock material can comprise a combination of a wire and powder.

Also disclosed herein are embodiments of a hardfacing layer formed from the feedstock material as disclosed herein.

In some embodiments, the hardfacing layer can comprise an ASTM G65A abrasion loss of less than 250 $mm^3$, and two cracks or fewer per square inch when forming the hardfacing layer from a PTA or laser cladding process. In some embodiments, the hardfacing layer can comprise an impermeable HVOF coating which exhibits a corrosion rate of 1 mpy or less in a 28% $CaCl_2$) electrolyte, pH=9.5 environment.

In some embodiments, the hardfacing layer can further comprise a hardness of 650 Vickers or greater, and an adhesion of 9,000 psi or greater when forming the hardfacing layer from a HVOF thermal spray process.

In some embodiments, the hardfacing layer can be applied onto a hydraulic cylinder, tension riser, mud motor rotor, or oilfield component application.

In some embodiments, the hardfacing layer can comprise a hardness of 750 Vickers or greater, and a porosity of 2 volume % or less, preferably 0.5% or less when forming the hardfacing layer from a HVOF thermal spray process.

DETAILED DESCRIPTION

Figure 1:
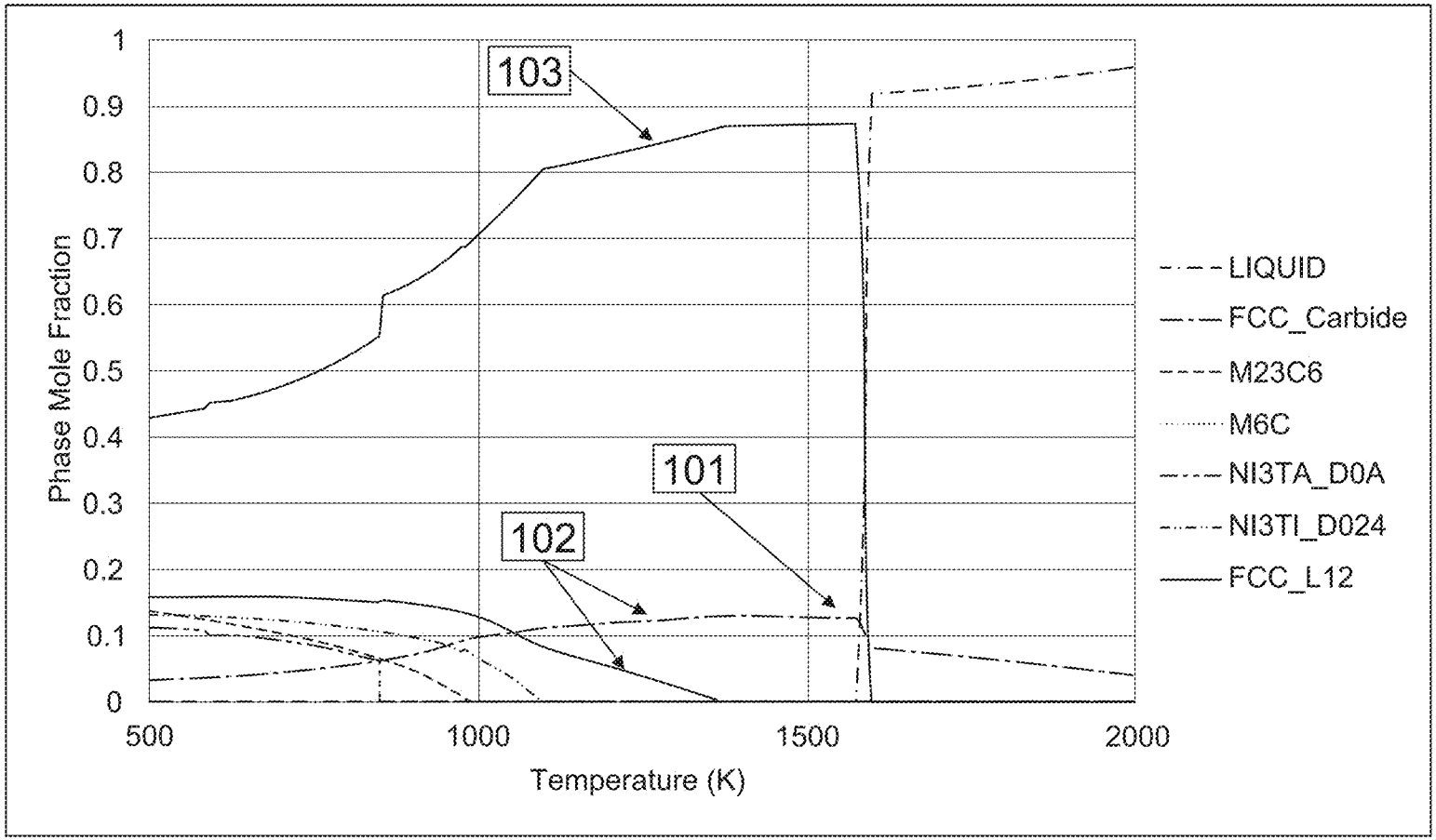
FIG. 1 illustrates a phase mole fraction vs. temperature diagram of alloy P82-X6 showing the mole fraction of phases present in an alloy at different temperatures.

Embodiments of the present disclosure include but are not limited to hardfacing/hardbanding materials, alloys or powder compositions used to make such hardfacing/hardbanding materials, methods of forming the hardfacing/hardbanding materials, and the components or substrates incorporating or protected by these hardfacing/hardbanding materials.

In certain applications it can be advantageous to form a metal layer with high resistance to abrasive and erosive wear, and to resist corrosion. Disclosed herein are embodiments of nickel-based alloys that have been developed to provide abrasive and corrosion resistance. Industries which would benefit from combined corrosion and wear resistance include marine applications, power industry coatings, oil & gas applications, and coatings for glass manufacturing.

In some embodiments, alloys disclosed herein can be engineered to form a microstructure which possesses both a matrix chemistry similar to some known alloys, such as Inconel and Hastelloys, while also including additional elements to improve performance. For example, carbides can be added into the matrix of the material. In particular, improved corrosion resistance and improved abrasion resistance can be formed.

It should be understood that in the complex alloy space, it is not possible to simply remove an element or substitute one for the other and yield equivalent results.

In some embodiments, nickel-based alloys as described herein may serve as effective feedstock for the plasma transferred arc (PTA), laser cladding hardfacing processes including high speed laser cladding, and thermal spray processing including high velocity oxygen fuel (HVOF) thermal spray, though the disclosure is not so limited. Some embodiments include the manufacture of nickel-based alloys into cored wires for hardfacing processes, and the welding methods of nickel-based wires and powders using wire fed laser and short wave lasers.

The term alloy can refer to the chemical composition of a powder used to form a metal component, the powder itself, the chemical composition of a melt used to form a casting component, the melt itself, and the composition of the metal component formed by the heating, sintering, and/or deposition of the powder, including the composition of the metal component after cooling. In some embodiments, the term alloy can refer to the chemical composition forming the powder disclosed within, the powder itself, the feedstock itself, the wire, the wire including a powder, the combined composition of a combination of wires, the composition of the metal component formed by the heating and/or deposition of the powder, or other methodology, and the metal component.

In some embodiments, alloys manufactured into a solid or cored wire (a sheath containing a powder) for welding or for use as a feedstock for another process may be described by specific chemistries herein. For example, the wires can be used for a thermal spray. Further, the compositions disclosed below can be from a single wire or a combination of multiple wires (such as 2, 3, 4, or 5 wires).

In some embodiments, the alloys can be applied by a thermal spray process to form a thermal spray coating, such as HVOF alloys. In some embodiments, the alloys can be applied as a weld overlay. In some embodiments, the alloys can be applied either as a thermal spray or as a weld overlay, e.g., having dual use.

Metal Alloy Composition

In some embodiments, an article of manufacture, such as a composition of a feedstock as disclosed herein, can comprise Ni and in weight percent:

B: 0-4 (or about 0-about 4);
C: 0-9.1 (or about 0-about 9.1);
Cr: 0-60.9 (or about 0-about 60.9);
Cu: 0-31 (or about 0-about 31);
Fe: 0-4.14 (or about 0-about 4.14);
Mn: 0-1.08 (or about 0-about 1.08);
Mo: 0-10.5 (or about 0-about 10.5);
Nb: 0-27 (or about 0-about 27);
Si: 0-1 (or about 0-about 1);
Ti: 0-24 (or about 0-about 24); and
W: 0-12 (or about 0-about 12).

In some embodiments, an article of manufacture, such as a composition of a feedstock as disclosed herein, can comprise Ni and in weight percent:

C: 0.5-2 (or about 0.5-about 2);
Cr: 10-30 (or about 10-about 30);
Mo: 5-20 (or about 5-about 20); and
Nb+Ti: 2-10 (or about 2-about 10).

In some embodiments, an article of manufacture, such as a composition of a feedstock as disclosed herein, can comprise Ni and in weight percent:

C: 0.8-1.6 (or about 0.8-about 1.6);
Cr: 14-26 (or about 14-about 26);
Mo: 8-16 (or about 8-about 16); and
Nb+Ti: 2-10 (or about 2-about 10).

In some embodiments, an article of manufacture, such as a composition of a feedstock as disclosed herein, can comprise Ni and in weight percent:

C: 0.84-1.56 (or about 0.84-about 1.56);
Cr: 14-26 (or about 14-about 26);
Mo: 8.4-15.6 (or about 8.4-about 15.6); and
Nb+Ti: 4.2-8.5 (or about 4.2-about 8.5).

In some embodiments, an article of manufacture, such as a composition of a feedstock as disclosed herein, can comprise Ni and in weight percent:

C: 0.84-1.56 (or about 0.84-about 1.56);
Cr: 14-26 (or about 14-about 26);
Mo: 8.4-15.6 (or about 8.4-about 15.6);
Nb: 4.2-7.8 (or about 4.2-about 7.8); and
Ti: 0.35-0.65 (or about 0.35-0.65).

In some embodiments, an article of manufacture, such as a composition of a feedstock as disclosed herein, can comprise Ni and in weight percent:

C: 1.08-1.32 (or about 1.08-about 1.32)
Cr: 13-22 (or about 18-about 22);
Mo: 10.8-13.2 (or about 10.8-about 13.2); and
Nb: 5.4-6.6 (or about 5.4-about 6.6).

In some embodiments, an article of manufacture, such as a composition of a feedstock as disclosed herein, can comprise Ni and in weight percent:

C: 0.5-2 (or about 0.5-about 2);
Cr: 10-30 (or about 10-about 30);
Mo: 5.81-18.2 (or about 5.81-about 18.2); and
Nb+Ti: 2.38-10 (or about 2.38-about 10).

In some embodiments, an article of manufacture, such as a composition of a feedstock as disclosed herein, can comprise one of the following, in weight percent:

C: 0.5, Cr: 24.8, Mo: 9.8, Ni: BAL (or C: about 0.5, Cr: about 24.8, Mo: about 9.8, Ni: BAL);
C: 0.35-0.65, Cr: 17.3-32.3, Mo: 6.8-12.7, Ni: BAL (or C: about 0.35-about 0.65,
Cr: about 17.3-about 32.3, Mo: about 6.8-about 12.7, Ni: BAL);
C: 0.45-0.55, Cr: 22.3-27.3, Mo: 8.8-10.8, Ni: BAL (or C: about 0.45-about 0.55,
Cr: about 22.3-about 27.3, Mo: about 8.8-about 10.8, Ni: BAL);
C: 0.8, Cr: 25, Mo: 14, Ni: BAL (or C: about 0.8, Cr: about 25, Mo: about 14, Ni: BAL);
C: 0.56-1.04, Cr: 17.5-32.5, Mo: 9.8-18.2, Ni: BAL (or C: about 0.56-about 1.04,
Cr: about 17.5-about 32.5, Mo: about 9.8-about 18.2, Ni: BAL);
C: 0.7-0.9, Cr: 22.5-27.5, Mo: 12.6-15.4, Ni: BAL (or C: about 0.7-about 0.9, Cr: about 22.5-about 27.5, Mo: about 12.6-about 15.4, Ni: BAL);
C: 1.2, Cr: 24, Mo: 14, Ni: BAL (or C: about 1.2, Cr: about 24, Mo: about 14, Ni: BAL);
C: 0.84-1.56, Cr: 16.8-31.2, Mo: 9.8-18.2, Ni: BAL (or C: about 0.84-about 1.56,
Cr: about 16.8-about 31.2, Mo: about 9.8-about 18.2, Ni: BAL);
C: 1.08-1.32, Cr: 21.6-26.4, Mo: 12.6-15.4, Ni: BAL (or C: about 1.08-about 1.32,
Cr: about 21.6-about 26.4, Mo: about 12.6-about 15.4, Ni: BAL);
C: 1.2, Cr: 20, Mo: 12, Nb: 6, Ti: 0.5, Ni: BAL (or C: about 1.2, Cr: about 20, Mo: about 12, Nb: about 6, Ti: about 0.5, Ni: BAL);
C: 0.84-1.56, Cr: 14-26, Mo: 8.4-15.6, Nb: 4.2-7.8, Ti: 0.35-0.65, Ni: BAL (or C: about 0.84-about 1.56, Cr: about 14-about 26, Mo: about 8.4-about 15.6, Nb: about 4.2-about 7.8, Ti: about 0.35-about 0.65, Ni: BAL);
C: 1.08-1.32, Cr: 18-22, Mo: 10.8-13.2, Nb: 5.4-6.6, Ti: 0.45-0.55, Ni: BAL (or C: about 1.08-about 1.32, Cr: about 18-about 22, Mo: about 10.8-about 13.2, Nb: about 5.4-about 6.6, Ti: about 0.45-about 0.55, Ni: BAL);
C: 1.6, Cr: 18, Mo: 14, Nb: 6, Ni: BAL (or C: about 1.6, Cr: about 18, Mo: about 14, Nb: about 6, Ni: BAL);
C: 1.12-2.08, Cr: 12.6-23.4, Mo: 9.8-18.2, Nb: 4.2-7.8, Ni: BAL (or C: about 1.12-about 2.08, Cr: about 12.6-about 23.4, Mo: about 9.8-about 18.2, Nb: about 4.2-about 7.8, Ni: BAL);
C: 1.44-1.76, Cr: 16.2-19.8, Mo: 12.6-15.4, Nb: 5.4-6.6, Ni: BAL (or C: about 1.44-about 1.76, Cr: about 16.2-about 19.8, Mo: about 12.6-about 15.4, Nb: about 5.4-about 6.6, Ni: BAL).

In some embodiments, an article of manufacture, such as a composition of a feedstock as disclosed herein, can comprise Ni and in weight percent C: 1.4, Cr: 16, Fe: 1.0, Mo: 10, Nb: 5, Ti: 3.8; (or C: about 1.4, Cr: about 16, Fe: about 1.0, Mo: about 10, Nb: about 5, Ti: about 3.8);
B: 3.5, Cu: 14 (or B: about 3.5, Cu: about 14);
B: 2.45-4.55 (or about 2.45-about 4.55), Cu: 9.8-18.2 (or about 9.8 to about 18.2);
B: 3.15-3.85 (or about 3.15-about 3.85), Cu: 12.6-15.4 (or about 12.6-about 15.4);

B: 4.0, Cr: 10, Cu 16 (or B: about 4.0, Cr: about 10, Cu about 16);

B: 2.8-5.2 (or about 2.8-about 5.2), Cr: 7-13 (or about 7-about 13), Cu: 11.2-20.8 (or about 11.2-about 20.8);

B: 3.6-4.4 (or about 3.6-about 4.4), Cr: 9-11 (or about 9-about 11), Cu: 14.4-17.6 (or about 14.4-about 17.6); or C: 1.2, Cr: 20, Mo: 12, Nb: 6, Ti: 0.5 (or C: about 1.2, Cr: about 20, Mo: about 12, Nb: about 6, Ti: about 0.5).

In some embodiments, an article of manufacture, such as a composition of a feedstock as disclosed herein, can comprise agglomerated and sintered blends of, in weight percent:

75-85% WC+15-25% Monel;

65-75% WC+25-35% Monel;

60-75% WC+25-40% Monel;

75-85% $Cr_3C_2$+15-25% Monel;

65-75% $Cr_3C_2$+25-35% Monel;

60-75% $Cr_3C_2$+25-40% Monel;

60-85% WC+15-40% Ni30Cu;

60-85% $Cr_3C_2$+15-40% Ni30Cu;

75-85% (50/50 vol. %) WC/$Cr_3C_2$+15-25% Monel;

75-85% (50/50 vol. %) WC/$Cr_3C_2$+25-35% Monel;

75-85% WC/$Cr_3C_2$+15-25% Monel;

75-85% WC/$Cr_3C_2$+25-35% Monel; or 60-90% hard phase+10-40% Monel alloy.

In the above, hard phases are one or more of the following: Tungsten Carbide (WC) and/or Chromium Carbide ($Cr_3C_2$). Monel is a nickel copper alloy of the target composition Ni BAL 30 wt. % Cu with a common chemistry tolerance of 20-40 wt. % Cu, or more preferably 28-34 wt. % Cu with known impurities including but not limited to C, Mn, S, Si, and Fe. Monel does not include any carbides, and thus embodiments of the disclosure add in carbides, such as tungsten carbides and/or chromium carbides. Tungsten carbide is generally described by the formula W: BAL, 4-8 wt. % C. In some embodiments, tungsten carbide can be described by the formula W: BAL, 1.5 wt. % C.

In some embodiments with 60-85% WC+Ni30Cu, the article of manufacture can be, in weight percent:

Ni: 10.5-28 (or about 10.5-about 28);

Cu: 4.5-12 (or about 4.5-about 12);

C: 3.66-5.2 (or about 3.66-about 5.2);

W: 56.34-79.82 (or about 56.34-about 79.82).

In some embodiments with 60-85% $Cr_3C_2$+Ni30Cu, the article of manufacture can be, in weight percent:

Ni: 10.5-28 (or about 10.5-about 28);

Cu: 4.5-12 (or about 4.5-about 12);

C: 7.92-11.2 (or about 7.92-about 11.2);

W: 52.1-73.78 (or about 52.1-about 73.79).

Thus, the above feedstock description indicates that tungsten carbide, a known alloy of that simple chemical formula, was mechanically blended with Monel (as described by the simple Ni30Cu formula in the prescribed ratio). During this overall process many particles stick together such that a new 'agglomerated' particle is formed. In each case the agglomerated particle is comprised of the described ratios.

Table I lists a number of experimental alloys, with their compositions listed in weight percent.

TABLE I

List of Experimental Nickel-Based Alloy Compositions in wt. %

| Alloy | Ni | B | C | Cr | Cu | Fe | Mn | Mo | Nb | Si | Ti | W |
|---|---|---|---|---|---|---|---|---|---|---|---|---|
| P82-X1 | 59 | | 2 | 25.5 | | | | 10.5 | 3 | | | |
| P82-X2 | 54.5 | | 2 | 30 | | | | 10.5 | 3 | | | |
| P82-X3 | 55.08 | | 1.3 | 28.95 | | 4.14 | | 7.47 | 3.06 | | | |
| P82-X4 | 48.96 | | 2.6 | 35.4 | | 3.68 | | 6.64 | 2.72 | | | |
| P82-X5 | 42.84 | | 3.9 | 41.85 | | 3.22 | | 5.81 | 2.38 | | | |
| P82-X6 | 62.8 | | 1.4 | 16 | | 1 | | 10 | 5 | | 3.8 | |
| P82-X7 | 63.1 | | 1.3 | 20 | | 1 | | 10 | 3.6 | | 1 | |
| P82-X8 | 58.5 | | 1.9 | 19 | | 1 | | 10 | 5 | | 4.6 | |
| P82-X9 | 62 | | 2 | 15 | | 1 | | 10 | 5 | | 5 | |
| P82-X10 | 66.6 | | 1.3 | 16 | | 1 | | 10 | 6 | | 0.4 | |
| P82-X11 | 69.8 | | 2 | 16 | | 1 | | 10 | 1.4 | | 1.8 | |
| P82-X12 | 66.4 | | 2 | 16 | | 1 | | 10 | 6 | | 0.6 | |
| P76-X1 | 47.6 | | 2.4 | 26 | 24 | | | | | | | |
| P76-X2 | 50.4 | | 1.6 | 22 | 26 | | | | | | | |
| P76-X3 | 53.8 | | 1.2 | 17 | 28 | | | | | | | |
| P76-X4 | 53.6 | | 2.6 | 17.4 | 26.4 | | | | | | | |
| P76-X5 | 46.9 | | 3.9 | 26.1 | 23.1 | | | | | | | |
| P76-X6 | 40.2 | | 5.2 | 34.8 | 19.8 | | | | | | | |
| P76-X1-1 | 47.6 | | 2.4 | 26 | 24 | | | | | | | |
| P76-X6-1 | 40.2 | | 5.2 | 34.8 | 19.8 | | | | | | | |
| P76-X6-2 | 40.2 | | 5.2 | 34.8 | 19.8 | | | | | | | |
| P76-X7 | 63.2 | | 0.8 | | 29 | | | | 6 | | 1 | |
| P76-X8 | 60.8 | | 1.2 | | 28 | | | | 9 | | 1 | |
| P76-X9 | 65 | | 1 | | 25 | | | | 8 | | 1 | |
| P76-X10 | 60 | | 2 | | 30 | | | | | | 8 | |
| P76-X11 | 64 | | 1 | | 31 | | | | | | 4 | |
| P76-X12 | 58.5 | | 2.5 | | 28 | | | | | | 11 | |
| P76-X13 | 59.22 | | 2 | | 27.72 | 1.98 | 1.08 | | | | 8 | |
| P76-X14 | 52.64 | | 4 | | 24.64 | 1.76 | 0.96 | | | | 16 | |
| P76-X14_2 | 53.36 | | 4 | | 26.72 | | | | | | 16 | |
| P76-X15 | 46.69 | | 6 | | 23.38 | | | | | | 24 | |
| P76-X17 | 53.36 | | 2.28 | | 26.72 | | | | 18 | | | |
| P76-X18 | 46.69 | | 3.42 | | 23.38 | | | | 27 | | | |
| P76-X19 | 19.98 | | 9.1 | 60.9 | 10.02 | | | | | | | |
| P76-X20 | 38.86 | | 5.6 | 34.8 | 19.14 | | | | | | 1.6 | |
| P76-X21 | 82 | 2 | | | 10 | | | 5.00 | | 1.0 | | |
| P76-X22 | 76.5 | 2.5 | | | 10 | | | 10.00 | | 1.0 | | |
| P76-X23 | 82.5 | 3.5 | | | 14 | | | | | | | |

TABLE I-continued

List of Experimental Nickel-Based Alloy Compositions in wt. %

| Alloy | Ni | B | C | Cr | Cu | Fe | Mn | Mo | Nb | Si | Ti | W |
|---|---|---|---|---|---|---|---|---|---|---|---|---|
| P76-X24 | 70 | 4 | | 10 | 16 | | | | | | | |
| P76-X25 | 78 | 4 | | | 11 | | | 7.00 | | | | |
| P76-X26 | 71 | 2 | | | 22 | | | 5.00 | | | | |
| P76-X27 | 71.5 | 3.5 | | | 13 | | | | | | | 12 |
| P76-X28 | 76.5 | 3.5 | | | 13 | | | | | | | 7 |

In some embodiments, P76 alloys can be thermal spray alloys and P82 alloys can be weld overlay alloys (such as PTA or laser). However, the disclosure is not so limited. For example, any of the compositions as disclosed herein can be effective for hardfacing processes, such as for plasma transferred arc (PTA), laser cladding hardfacing processes including high speed laser cladding, and thermal spray processes such as high velocity oxygen fuel (HVOF) thermal spray.

In Table I, all values can be "about" the recited value as well. For example, for P82-X1, Ni: 59 (or about 59).

In some embodiments, the disclosed compositions can be the wire/powder, the coating or other metallic component, or both.

The disclosed alloys can incorporate the above elemental constituents to a total of 100 wt. %. In some embodiments, the alloy may include, may be limited to, or may consist essentially of the above named elements. In some embodiments, the alloy may include 2 wt. % (or about 2 wt. %) or less, 1 wt. % (or about 1 wt. %) or less, 0.5 wt. % (or about 0.5 wt. %) or less, 0.1 wt. % (or about 0.1 wt. %) or less or 0.01 wt. % (or about 0.01 wt. %) or less of impurities, or any range between any of these values. Impurities may be understood as elements or compositions that may be included in the alloys due to inclusion in the feedstock components, through introduction in the manufacturing process.

Further, the Ni content identified in all of the compositions described in the above paragraphs may be the balance of the composition, or alternatively, where Ni is provided as the balance, the balance of the composition may comprise Ni and other elements. In some embodiments, the balance may consist essentially of Ni and may include incidental impurities.

Thermodynamic Criteria

In some embodiments, alloys can be characterized by their equilibrium thermodynamic criteria. In some embodiments, the alloys can be characterized as meeting some of the described thermodynamic criteria. In some embodiments, the alloys can be characterized as meeting all of the described thermodynamic criteria.

A first thermodynamic criterion pertains to the total concentration of extremely hard particles in the microstructure. As the mole fraction of extremely hard particles increases the bulk hardness of the alloy may increase, thus the wear resistance may also increase, which can be advantageous for hardfacing applications. For the purposes of this disclosure, extremely hard particles may be defined as phases that exhibit a hardness of 1000 Vickers or greater (or about 1000 Vickers or greater). The total concentration of extremely hard particles may be defined as the total mole % of all phases that meet or exceed a hardness of 1000 Vickers (or about 1000 Vickers) and is thermodynamically stable at 1500K (or about 1500K) in the alloy.

In some embodiments, the extremely hard particle fraction is 3 mole % or greater (or about 3 mole % or greater), 4 mole % or greater (or about 4 mole % or greater), 5 mole % or greater (or about 5 mole % or greater), 8 mole % or greater (or about 8 mole % or greater), 10 mole % or greater (or about 10 mole % or greater), 12 mole % or greater (or about 12 mole % or greater) or 15 mole % or greater (or about 15 mole % or greater), 20 mole % or greater (or about 20 mole % or greater), 30 mole % or greater (or about 30 mole % or greater), 40 mole % or greater (or about 40 mole % or greater), 50 mole % or greater (or about 50 mole % or greater), 60 mole % or greater (or about 60 mole % or greater), or any range between any of these values.

In some embodiments, the extremely hard particle fraction can be varied according to the intended process of the alloy. For example, for thermal spray alloys, the hard particle fraction can be between 40 and 60 mol. % (or between about 40 and about 60 mol. %). For alloys intended to be welded via laser, plasma transfer arc, or other wire welding application the hard particle phase fraction can be between 15 and 30 mol. % (or between about 15 and about 30 mol. %).

A second thermodynamic criterion pertains to the amount of hypereutectic hard phases that form in the alloy. A hypereutectic hard phase is a hard phase that begins to form at a temperature higher than the eutectic point of the alloy. The eutectic point of these alloys is the temperature at which the FCC matrix begins to form.

In some embodiments, hypereutectic hard phases total to 40 mol. % or more (or about 40% or more), 45 mol. % or more (or about 45% or more), 50 mol. % or more (or about 50% or more), 60 mol. % or more (or about 60% or more), 70 mol. % or more (or about 70% or more), 75 mol. % or more (or about 75% or more) or 80 mol. % or more (or about 80% or more) of the total hard phases present in the alloy, or any range between any of these values.

A third thermodynamic criterion pertains to the corrosion resistance of the alloy. The corrosion resistance of nickel-based alloys may increase with higher weight percentages of chromium and/or molybdenum present in the FCC matrix. This third thermodynamic criterion measures the total weight % of chromium and molybdenum in the FCC matrix at 1500K (or about 1500K).

In some embodiments, the total weight % of chromium and molybdenum in the matrix is 15 weight % or greater (or about 15 weight % or greater), 18 weight % or greater (or about 18 weight % or greater), 20 weight % or greater (or about 20 weight % or greater), 23 weight % or greater (or about 23 weight % or greater), 25 weight % or greater (or about 25 weight % or greater), 27 weight % or greater (or about 27 weight % or greater) or 30 weight % or greater (or about 30 weight % or greater), or any range between any of these values.

A fourth thermodynamic criterion relates to the matrix chemistry of the alloy. In some embodiments, it may be beneficial to maintain a similar matrix chemistry to a known alloy such as, for example, Inconel 622, Inconel 625, Inconel 686, Hastelloy C276, Hastelloy X, or Monel 400. In some embodiments, to maintain a similar matrix chemistry to a known alloy, the matrix chemistry of alloys at 1300K was compared to those of a known alloy. Comparisons of this sort are termed Matrix Proximity. In general, such superalloys can be represented by the formula, in wt. %, Ni: BAL, Cr: 15-25, Mo: 8-20.

Inconel 622 Cr: 20-22.5, Mo: 12.5-14.5, Fe: 2-6, W: 2.5-3.5, Ni: BAL

Inconel 625 Cr: 20-23, Mo: 8-10, Nb+Ta: 3.15-4.15, Ni: BAL

Inconel 686 Cr: 19-23, Mo: 15-17, W: 3-4.4, Ni: BAL

Hastelloy C276 Cr: 16, Mo: 16, Iron 5, W: 4, Ni: BAL

Hastelloy X Cr: 22, Fe: 18, Mo: 9, Ni: BAL

Monel 400 Cu: 28-34, Ni: BAL

In some embodiments, the matrix proximity is 50% (or about 50%) or greater, 55% (or about 55%) or greater, 60% (or about 60%) or greater, 70% (or about 70%) or greater, 80% (or about 80%) or greater, 85% (or about 85%) or greater, 90% (or about 90%) or greater, of any of the above known alloys. Matrix proximity can be determined in a number of ways, such as energy dispersive spectroscopy (EDS).

The equation below can be used to calculate the similarity or proximity of the modelled alloy matrix to an alloy of known corrosion resistance. A value of 100% means an exact match between the compared elements.

$$\sum_{n=1}^{m} \frac{r_n}{\sum r_n}\left(1 - \left|\frac{r_n - xn}{r_n}\right|\right.$$

$r_n$ is the percentage of the $n^{th}$ element in the reference alloy;

$x_n$ is the calculated percentage of the $n^{th}$ element in the matrix of the modelled alloy;

$\Sigma r_n$ is the total percentage of elements under comparison;

m is the number of solute elements used in the comparison.

A fifth thermodynamic criterion relates to the liquidus temperature of the alloy, which can help determine the alloy's suitability for the gas atomization manufacturing process. The liquidus temperature is the lowest temperature at which the alloy is still 100% liquid. A lower liquidus temperature generally corresponds to an increased suitability to the gas atomization process. In some embodiments, the liquidus temperature of the alloy can be 1850 K (or about 1850 K) or lower. In some embodiments, the liquidus temperature of the alloy can be 1600 K (or about 1600 K) or lower. In some embodiments, the liquidus temperature of the alloy can be 1450 K (or about 1450 K) or lower.

The thermodynamic behavior of alloy P82-X6 is shown in FIG. 1. The diagram depicts a material which precipitates a hypereutectic FCC carbide 101 in a nickel matrix 103, which is greater than 5% at 1500K. 101 depicts the FCC carbide fraction as a function of temperature, which forms an isolated hypereutectic phase. 102 specifies the total hard phase content at 1300 K, which includes the FCC carbide in addition to an M6C carbide. Thus, the hypereutectic hard phases make up more than 50% of the total hard phases of the alloy. 103 species the matrix of the alloy, which is FCC_L12 Nickel matrix. The matrix proximity of the alloy 103 is greater than 60% when compared to Inconel 625.

A $M_6C$ type carbide also precipitates at a lower temperature to form a total carbide content of about 15 mol. % at 1300K (12.6% FCC carbide, 2.4% $M_6C$ carbide). The FCC carbide representing the isolated carbides in the alloy and forming the majority (>50%) of the total carbides in the alloy. The arrow points specifically to the point at which the composition of the FCC_L12 matrix is mined for insertion into the matrix proximity equation. As depicted in this example, the volume fraction of all hard phases exceeds 5 mole %, with over 50% of the carbide fraction forming as a hypereutectic phase known to form an isolated morphology with the remaining FCC_L12 matrix phase possessing over 60% proximity with Inconel 625.

In this calculation, although not depicted in FIG. 1, the chemistry of the FCC_L12 matrix phase is mined. The matrix chemistry is 18 wt. % Cr, 1 wt. % Fe, 9 wt. % Mo, and 1 wt. % Ti, balance Nickel. It can be appreciated that the matrix chemistry of P82-X6 is completely different than the bulk chemistry of P82-X6. P82-X6 is designed to have corrosion performance similar to Inconel 625 and the matrix proximity with Inconel 625 is 87%.

Figure 2:
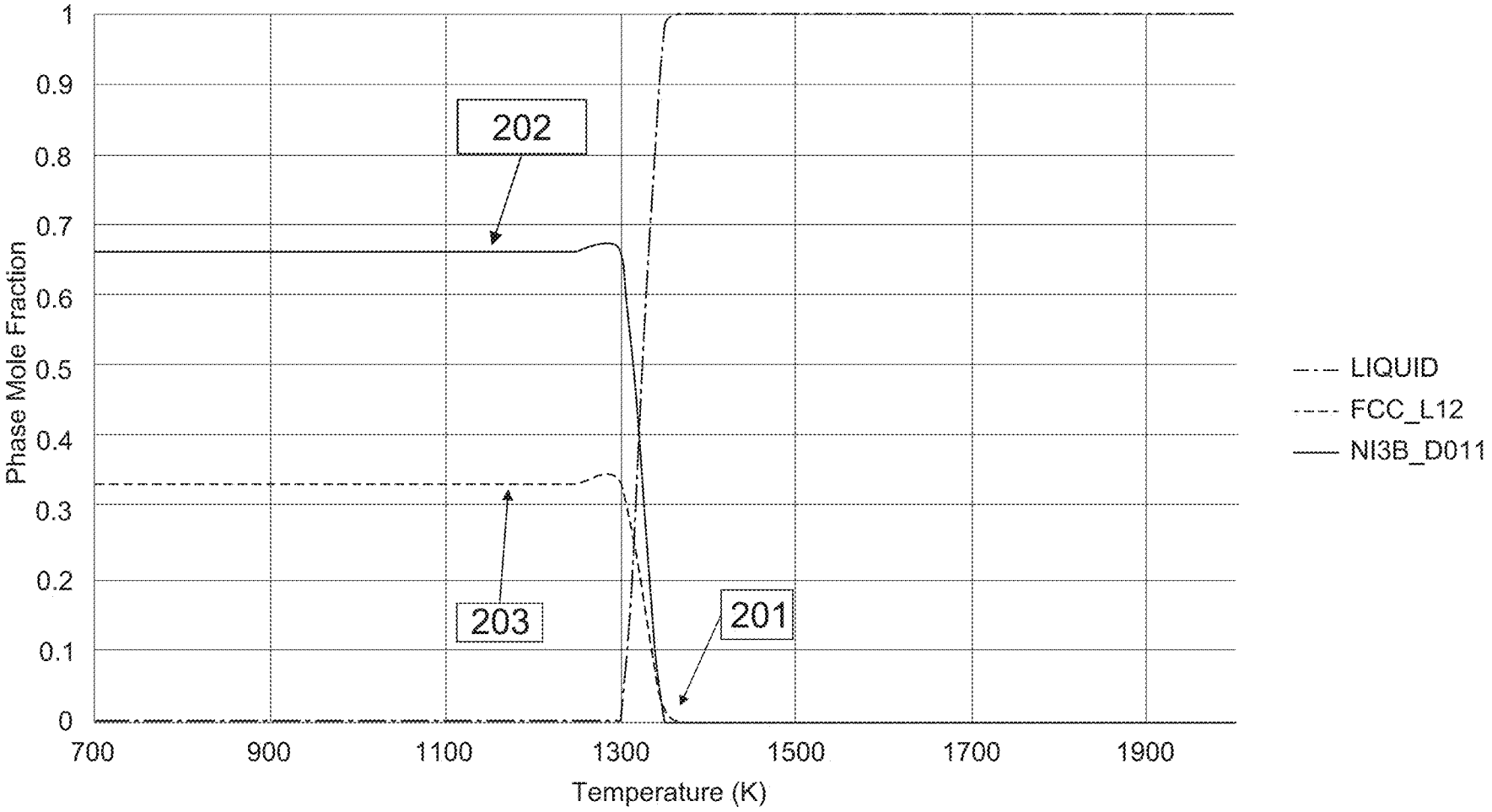
FIG. 2 illustrates a phase mole fraction vs. temperature diagram of alloy P76-X23 showing the mole fraction of phases present in an alloy at different temperatures.

The thermodynamic behavior of alloy P76-X23 is shown in FIG. 2. The diagram depicts a material which precipitates a eutectic $Ni_3B$ 203 in a nickel matrix 201. 201 calls out the liquidus temperature of the alloy, which is below 1850K according to a preferred embodiment. 202 depicts the mole fraction of hard phases in the alloy, in this case nickel boride ($Ni_3B$) which exceeds 5 mol. % at 1200K. 203 depicts the matrix phase fraction in which case the matrix chemistry is mined at 1200K and the matrix proximity is over 60% with Monel. The liquidus temperature of the alloy is 1400 K which makes the material very suitable for gas atomization. $Ni_3B$ is that hard phase in this example and is present at a mole fraction of 66% at 1300K. The matrix chemistry is 33 wt. % Cu, balance Nickel. It can be appreciated that the matrix chemistry of P76-X23 is completely different than the bulk chemistry of P76-X23. P76-X23 is designed to have corrosion performance similar to Monel 400 and the matrix proximity of P76-X23 with Monel 400 is 100%.

Microstructural Criteria

In some embodiments, alloys can be described by their microstructural criterion. In some embodiments, the alloys can be characterized as meeting some of the described microstructural criteria. In some embodiments, the alloys can be characterized as meeting all of the described microstructural criteria.

A first microstructural criterion pertains to the total measured volume fraction of extremely hard particles. For the purposes of this disclosure, extremely hard particles may be defined as phases that exhibit a hardness of 1000 Vickers or greater (or about 1000 Vickers or greater). The total concentration of extremely hard particles may be defined as the total mole % of all phases that meet or exceed a hardness of 1000 Vickers (or about 1000 Vickers) and is thermodynamically stable at 1500K (or about 1500K) in the alloy. In some embodiments, an alloy possesses at least 3 volume % (or at least about 3 volume %), at least 4 volume % (or at least about 4 volume %), at least 5 volume % (or at least about 5 volume %), at least 8 volume % (or at least about 8 volume %), at least 10 volume % (or at least about 10 volume %), at least 12 volume % (or at least about 12 volume %) or at least 15 volume % (or at least about 15 volume %) of extremely hard particles, at least 20 volume % (or at least about 20 volume %) of extremely hard particles, at least 30 volume % (or at least about 30 volume %) of extremely hard particles, at least 40 volume % (or at least about 40 volume %) of extremely hard particles, at least 50 volume % (or at least about 50 volume %) of extremely hard particles, or any range between any of these values.

In some embodiments, the extremely hard particle fraction can be varied according to the intended process of the alloy. For example, for thermal spray alloys, the hard particle fraction can be between 40 and 60 vol. % (or between about 40 and about 60 vol. %). For alloys intended to be welded via laser, plasma transfer arc, or other wire welding application the hard particle phase fraction can be between 15 and 30 vol. % (or between about 15 and about 30 vol. %).

A second microstructural criterion pertains to the fraction of hypereutectic isolated hard phases in an alloy. Isolated, as used herein, can mean that the particular isolated phase (such as spherical or partially spherical particles) remains unconnected from other hard phases. For example, an isolated phase can be 100% enclosed by the matrix phase. This can be in contrast to rod-like phases which can form long needles that act as low toughness "bridges," allowing cracks to work through the microstructure.

To reduce the crack susceptibility of an alloy it may be beneficial to form isolated hypereutectic phases rather than continuous grain boundary phases. In some embodiments, isolated hypereutectic hard phases total 40 vol. % (or about 40%) or more, 45 vol. % (or about 45%) or more, 50 vol. % (or about 50%) or more, 60 vol. % (or about 60%) or more, 70 vol. % (or about 70%) or more, 75 vol. % (or about 75%) or more or 80 vol. % (or about 80%) or more of the total hard phase fraction present in the alloy, or any range between any of these values.

A third microstructural criterion pertains to the increased resistance to corrosion in the alloy. To increase the resistance to corrosion in nickel based alloys it may be beneficial to have a high total weight % of chromium and molybdenum in a matrix. An Energy Dispersive Spectrometer (EDS) was used to determine the total weight % of chromium and molybdenum in a matrix. In some embodiments, the total content of chromium and molybdenum in the matrix may be 15 weight % or higher (or about 15 weight % or higher), 18 weight % or higher (or about 18 weight % or higher), 20 weight % or higher (or about 20 weight % or higher), 23 weight % or higher (or about 23 weight % or higher), 25 weight % or higher (or about 25 weight % or higher), 27 weight % or higher (or about 27 weight % or higher) or 30 weight % or higher (or about 30 weight % or higher), or any range between any of these values.

A fourth microstructural criterion pertains to the matrix proximity of an alloy compared to that of a known alloy such as, for example, Inconel 625, Inconel 686, or Monel. An Energy Dispersive Spectrometer (EDS) was used to measure the matrix chemistry of the alloy. In some embodiments, the matrix proximity is 50% (or about 50%) or greater, 55% (or about 55%) or greater, 60% (or about 60%) or greater, 70% (or about 70%) or greater, 80% (or about 80%) or greater, 85% (or about 85%) or greater or 90% (or about 90%) or greater of the known alloy, or any range between any of these values.

The matrix proximity is similar to what is described in the thermodynamic criteria section, in this case it is calculated. The difference between 'matrix chemistry' and 'matrix proximity' is that the chemistry is the actual values of Cr, Mo or other elements found in solid solution of the Nickel matrix. The proximity is the % value used as a quantitative measure to how closely the Nickel matrix of the designed alloy matches the chemistry of a known alloy possessing good corrosion resistance. For clarification, the known alloys such as Inconel are single phase alloys so the alloy composition is effectively the matrix composition, all the alloying elements are found in solid solution. This is not the case with the alloys described here in which we are precipitating hard phases for wear resistance.

Figure 3:
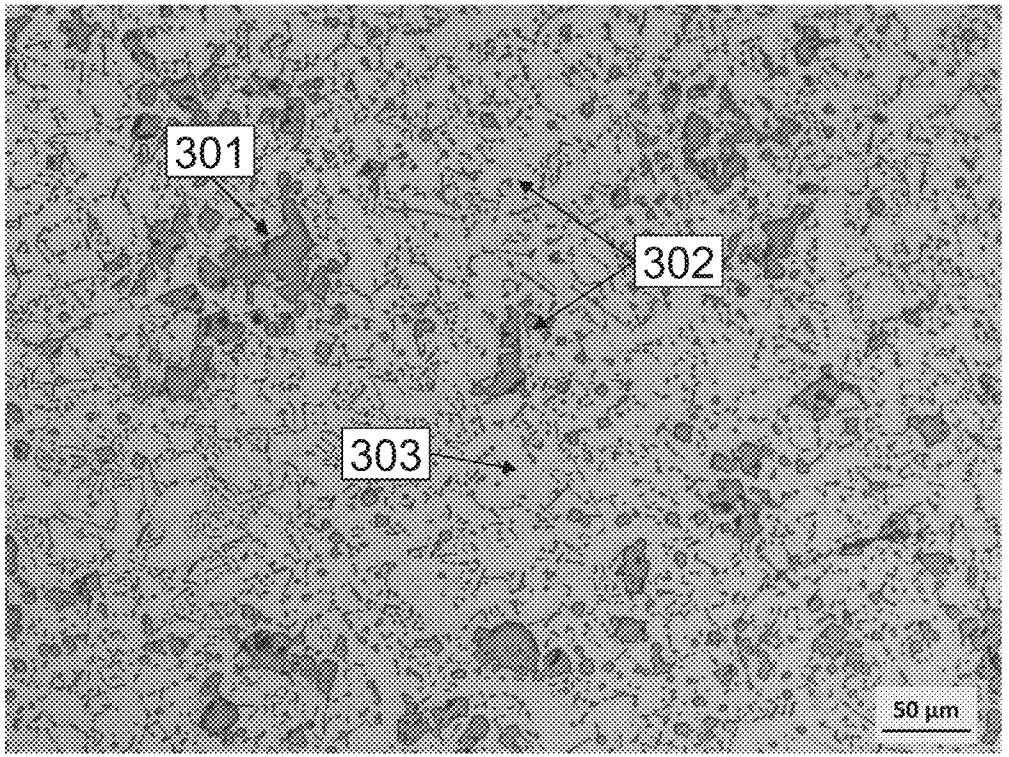
FIG. 3 shows an SEM image of one embodiment of an alloy P82-X6 with hard phases, hypereutectic hard phases, and a matrix.

FIG. 3 shows an SEM image of a microstructure for the P82-X6 as produced via PTA welding. In this case, the alloy was created as a powder blend for experimental purposes. 301 highlights the isolated Niobium carbide precipitates, which have a volume fraction at 1500K of greater than 5%, 302 highlights the hypereutectic hard phases, which makes up more than 50% of the total hard phases in the alloy, and 303 highlights the matrix, which has a matrix proximity greater than 60% when compared to Inconel 625. The carbide precipitates form a combination of isolated (larger size) and eutectic morphology (smaller size) both contributing to the total hard phase content. In this example the hard phases of isolated morphology make up over 50 vol. % of the total carbide fraction.

Performance Criteria

In some embodiments, a hardfacing layer is produced via a weld overlay process including but not limited to PTA cladding or laser cladding.

In some embodiments, an alloy can have a number of advantageous performance characteristics. In some embodiments, it can be advantageous for an alloy to have one or more of 1) a high resistance to abrasion, 2) minimal to no cracks when welded via a laser cladding process or other welding method, and 3) a high resistance to corrosion. The abrasion resistance of hardfacing alloys can be quantified using the ASTM G65A dry sand abrasion test. The crack resistance of the material can be quantified using a dye penetrant test on the alloy. The corrosion resistance of the alloy can be quantified using the ASTM G48, G59, and G61 tests. All of the listed ASTM tests are hereby incorporated by reference in their entirety.

In some embodiments, a hardfacing layer may have an ASTM G65A abrasion loss of less than 250 $mm^3$ (or less than about 250 $mm^3$), less than 100 $mm^3$ (or less than about 100 $mm^3$), less than 30 $mm^3$ (or less than about 30 $mm^3$), or less than 20 $mm^3$ (or less than about 20 $mm^3$).

In some embodiments, the hardfacing layer may exhibit 5 cracks per square inch, 4 cracks per square inch, 3 cracks per square inch, 2 cracks per square inch, 1 crack per square inch or 0 cracks per square inch of coating, or any range between any of these values. In some embodiments, a crack is a line on a surface along which it has split without breaking into separate parts.

In some embodiments, the hardfacing layer may have a corrosion resistance of 50% (or about 50%) or greater, 55% (or about 55%) or greater, 60% (or about 60%) or greater, 70% (or about 70%) or greater, 80% (or about 80%) or greater, 85% (or about 85%) or greater, 90% (or about 90%) or greater, 95% (or about 95%) or greater, 98% (or about 98%) or greater, 99% (or about 99%) or greater or 99.5% (or about 99.5%) or greater than a known alloy, or any range between any of these values.

Corrosion resistance is complex and can depend on the corrosive media being used. Preferably, the corrosion rate of embodiments of the disclosed alloys can be nearly equivalent to the corrosion rate of the comparative alloy they are intended to mimic. For example, if Inconel 625 has a corrosion rate of 1 mpy (mil per year). in a certain corrosive media, P82-X6 can have a corrosion resistance of 1.25 mpy or lower to yield a corrosion resistance of 80%. Corrosion resistance is defined as 1/corrosion rate for the purposes of this disclosure.

In some embodiments, the alloy can have a corrosion rate of 1 mpy or less (or about 1 mpy or less) in a 28% $CaCl_2$)

electrolyte, pH=9.5 environment. In some embodiments, the alloy can have a corrosion rate of 0.6 mpy or less (or about 0.6 mpy or less) in a 28% $CaCl_2$) electrolyte, pH=9.5 environment. In some embodiments, the alloy can have a corrosion rate of 0.4 mpy or less (or about 0.4 mpy or less) in a 28% $CaCl_2$) electrolyte, pH=9.5 environment.

In some embodiments, the alloy can have a corrosion resistance in a 3.5% sodium chloride solution for 16 hours according to G-59/G-61 of below 0.1 mpy (or below about 0.1 mpy). In some embodiments, the alloy can have a corrosion resistance in a 3.5% sodium chloride solution for 16 hours according to G-59/G-61 of below 0.08 mpy (or below about 0.08 mpy).

In some embodiments, a hardfacing layer is produced via a thermal spray process including but not limited to high velocity oxygen fuel (HVOF) thermal spray.

In some embodiments, the hardness of the coating can be 650 (or about 650) Vickers or higher. In some embodiments, the hardness of the thermal spray process can be 700 (or about 700) Vickers or higher. In some embodiments, the hardness of the thermal spray process can be 900 (or about 900) Vickers or higher.

In some embodiments, the adhesion of the thermal spray coating can be 7,500 (or about 7,500) psi or greater. In some embodiments, the adhesion the adhesion of the thermal spray coating can be 8,500 (or about 8,500) psi or greater. In some embodiments, the adhesion the adhesion of the thermal spray coating can be 9,500 (or about 9,500) psi or greater.

EXAMPLES

Example 1: PTA Welding of P82-X6

Figure 4:
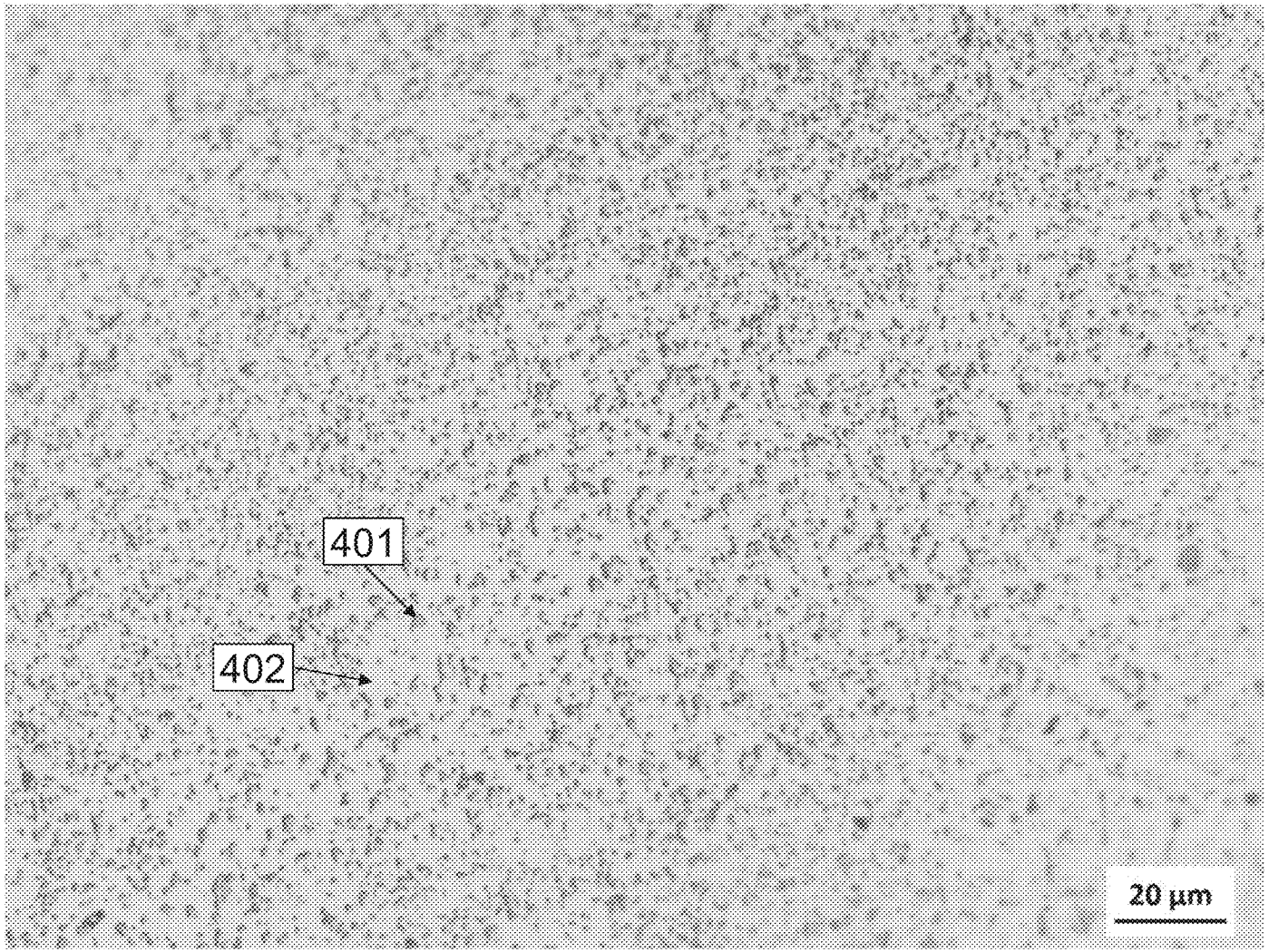
FIG. 4 shows an optical microscopy image of P82-X6 laser welded from the gas atomized powder per example 1, parameter set 1.

Alloy P82-X6 was gas atomized into a powder of 53-150 μm particle size distribution as suitable for PTA and/or laser cladding. The alloy was laser clad using two parameter sets: 1) 1.8 kW laser power and 20 L/min flow rate, and 2) 2.2 kW laser power and 14 L/min flow rate. In both cases, the coating showed fine isolated niobium/titanium carbide precipitates 401 in a Nickel matrix 402 as intended as shown in FIG. 4. The 300 grams force Vickers hardness of the laser claddings was 435 and 348 for parameter sets 1 and 2, respectively. The ASTM G65 tests were 1.58 g lost (209 $mm^3$) and 1.65 g (200 $mm^3$) lost for parameters sets 1 and 2, respectively.

Example 2: HVOF Spraying of P76-X23 and P76-X24

Alloys P76-X23 and P76-X24 were gas atomized into powders of 15-45 μm particle size distribution as suitable for HVOF thermal spray processing. Both powders forms an extremely fine scale morphology where a nickel matrix phase and nickel boride phase appear to be both present as predicted via the computational modelling, but very difficult to distinguish and measure quantitatively.

Figure 5:
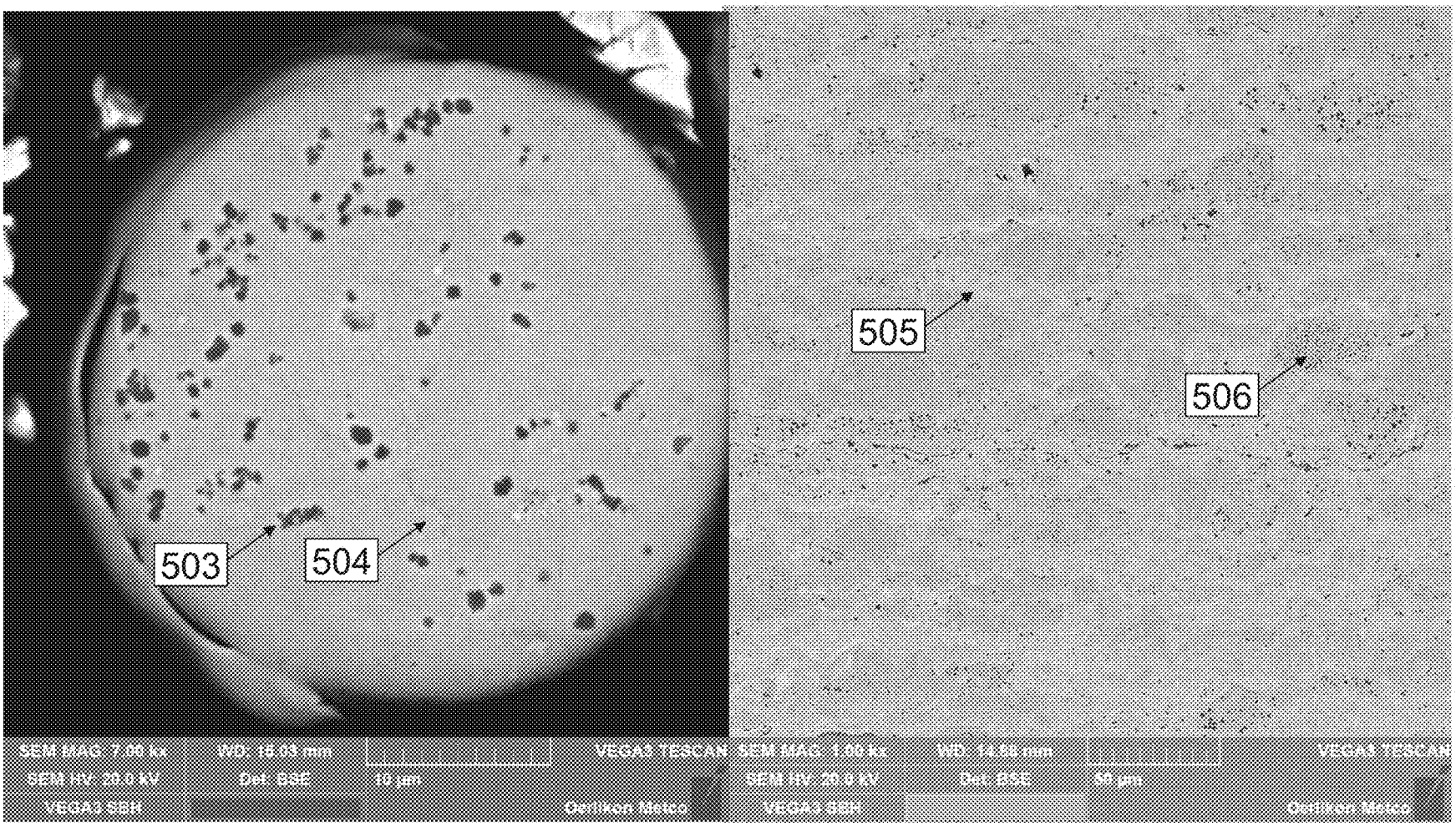
FIG. 5 shows SEM images of the gas atomized powder 501 and resultant coating 502 of the P76-X24 alloy per example 2.

As shown in FIG. 5, 501 being the gas atomized powder and 502 being the resultant coating of the powder, in addition to the matrix and Ni boride phase 504 (e.g., the eutectic nickel/nickel boride structure of the gas atomized powder), the P76-X24 alloy also forms chromium boride precipitates 503 as predicted by the model as fine isolated particles.

505 highlights a region of primarily nickel/nickel boride eutectic structure in the HVOF sprayed coating, and 506 highlights a region containing many chromium boride precipitates in the coating.

Both alloys were HVOF sprayed to about 200-300 μm coating thickness and formed dense coatings. The 300 grams force Vickers hardness of the coatings were 693 and 726 for P76-X23 and P76-X24 respectively. P76-X23 adhesion tests result in glue failure up to 9,999 psi, and P76-X24 showed 75% adhesion, 25% glue failure in two tests reaching 9,576 and 9,999 psi. ASTM G65A (converted from an ASTM G65B test) testing showed 87 $mm^3$ lost for P76-X24. ASTM G65A testing uses 6,000 revolutions, procedure B uses 2,000 revolutions and is typically used for thin coatings such as thermal spray coatings.

P76-X24 was tested in a 28% $CaCl_2$ electrolyte, pH=9.5 resulting in a measured corrosion rate of 0.4 mpy. In comparison, cracked hard chrome exhibits a rate of 1.06 mpy in a similar environment. Hard Cr is used as a relevant coating for a variety of application requiring both corrosion and abrasion resistance. In some embodiments, the alloy in the form of an HVOF coating produces a corrosion rate of 1 mpy or less in a 28% $CaCl_2$ electrolyte, pH=9.5 environment. In some embodiments, the alloy in the form of an HVOF coating can produce a corrosion rate of 0.6 mpy or less in a 28% $CaCl_2$ electrolyte, pH=9.5 environment. In some embodiments, the alloy in the form of an HVOF coating can produce a corrosion rate of 0.4 mpy or less in a 28% $CaCl_2$ electrolyte, pH=9.5 environment. In some embodiments, the alloy in the form of an HVOF coating produces a non-permeable coating per ECP (electrochemical potential) testing.

Example 3: HVOF Spraying of a $WC/Cr_3C_2$, Ni Alloy Matrix Blends

Figure 6:
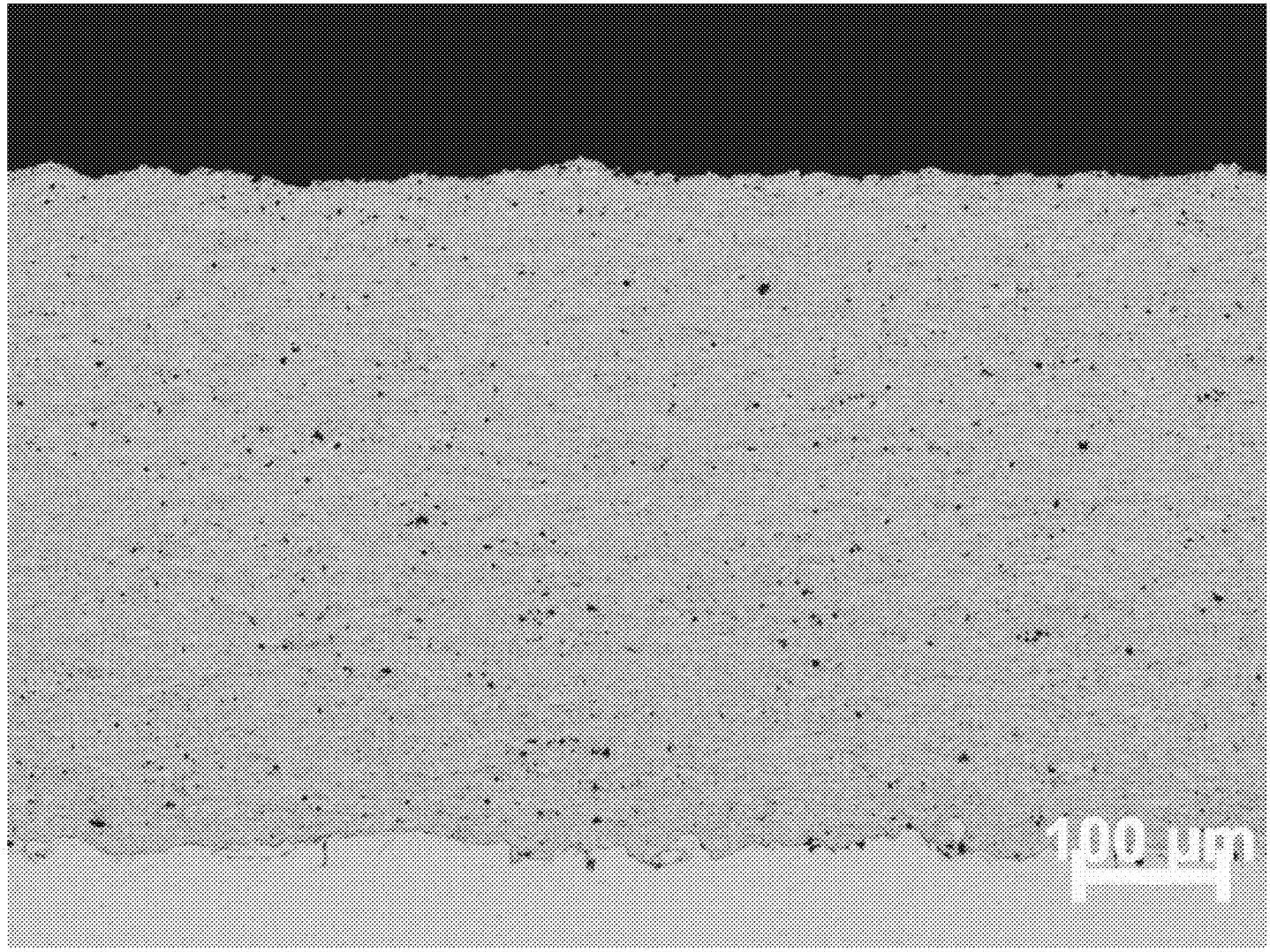
FIG. 6 shows an SEM image of an HVOF coating deposited from agglomerated and sintered powder of WC/$Cr_3C_2$+Ni alloy per example 3, specifically a blend of 80 wt. % WC/$Cr_3C_2$ (50/50 vol %) mixed with 20 wt. % Monel.

A blend of a blend of 80 wt. % $WC/Cr_3C_2$ (50/50 vol %) mixed with 20 wt. % Monel was agglomerated and sintered into 15-45 μm as suitable for thermal spray processing. The HVOF coating, as shown in FIG. 6, possessed a 300 gram Vickers hardness of 946 forming a dense coating of 0.43% measured porosity. The HVOF coating produced an ASTM G65A mass loss of about 12 $mm^3$. FIG. 6 illustrates an SEM image of an agglomerated and sintered powder of $WC/Cr_3C_2$+Ni alloy per example 3, specifically a blend of 80 wt. % $WC/Cr_3C_2$ (50/50 vol %) mixed with 20 wt. % Monel.

Example 4: Weld Studies of P82-X13, 14, 15, 18, 19 in Comparison with Inconel 625

A weld study was conducted evaluating several alloys of differing carbide contents and morphologies in comparison to Inconel 625. All of the alloys in the study were intended to form a matrix similar to Inconel 625, which is quantified by the matrix proximity, 100% equating to a matrix which is exactly similar to the Inconel 625 bulk composition. All the alloys were laser welded in three overlapping layers to test for crack resistance. Similarly, two layer welds of each alloy were produced via plasma transferred arc welding to test for cracking and other properties.

TABLE 2

Comparison of All Microstructures

| Alloy Name | GB Hard Phase | Iso Hard Phase | Matrix Proximity |
|---|---|---|---|
| Inconel 625 | 0% | 0% | 100% |
| P82-X13 | 10.50% | 0% | 100% |
| P82-X14 | 20.10% | 0% | 99% |
| P82-X15 | 30.40% | 0% | 84% |

TABLE 2-continued

| Comparison of All Microstructures | | | |
|---|---|---|---|
| Alloy Name | GB Hard Phase | Iso Hard Phase | Matrix Proximity |
| P82-X18 | 9.90% | 8.10% | 98% |
| P82-X19 | 20.00% | 8.00% | 98% |

The P82-X18 represents an embodiment of this disclosure producing favorable results at the conclusion of this study. P82-X18 is significantly harder than Inconel 625 in both processes, PTA and laser. Despite the increased hardness, no cracking was evident in the laser or PTA clad specimens. P82-X18 exhibits improved abrasion resistance as compared to Inconel 625 in both processes. The general trend for increased hardness is true for all the tested alloys as demonstrated in Table 3. However, surprisingly, the increased hardness does not generate an increased abrasion resistance in all cases. P82-X13, P82-X14, and P82-X15 all exhibited higher wear rates than Inconel 625 despite being harder and containing carbides. This result demonstrates the discovered advantageous carbide morphology as compared to total carbide fraction and alloy hardness.

Alloy P82-X18 meets thermodynamic, microstructural, and performance criteria of this disclosure. P82-X18 is predicted to form 8.1 mol. % isolated carbides and indeed forms 8-12% isolated carbides in the studied and industrially relevant weld processes. The alloy is also predicted to form 9.9 mol % grain boundary hard phases, and indeed forms grain boundary hard phases of 10 vol. % or less. The isolated carbide content is in excess of 40% of the total carbide content in the alloy. This elevated ratio of isolated carbide fraction provides enhanced wear resistance beyond what can be expected of total carbide fraction alone.

TABLE 3

| Comparison of Test Alloy Microhardness Values | | | | | | |
|---|---|---|---|---|---|---|
| Hardness $HV_1$ | Inco 625 | X13 | X14 | X15 | X18 | X19 |
| Ingot | 217 | 252 | 303 | 311 | 333 | 360 |
| PTAW | 236 | 309 | 342 | 376 | 375 | 394 |
| LASER | 282 | 338 | 370 | 424 | 389 | 438 |

TABLE 4

| Comparison of Abrasion Performance, ASTM G65 A $mm^3$ lost, of Test Alloys | | |
|---|---|---|
| | PTAW | LASER |
| Inco 625 | | 232 |
| X13 | 259 | 256 |
| X14 | 256 | 267 |
| X15 | 279 | 266 |
| X18 | 184 | 201 |
| X19 | 203 | 224 |

The matrix of P82-X18 was measured via Energy Dispersive Spectroscopy which yielded Cr: 19-20 wt. %, Mo: 10-12 wt., %, Ni: Balance. Thus, the matrix composition is quite similar and somewhat overlapping with a typical Inconel 625 manufacturing range which is: Cr: 20-23, Mo: 8-10, Nb+Ta: 3.15-4.15, Ni: BAL. P82-X18 was tested in G-48 ferric chloride immersion testing for 24 hours and, similar to Inconel 625, showed no corrosion. P82-X18 was corrosion tested in a 3.5% Sodium Chloride solution for 16 hours according to G-59/G-61 ASTM standard and measured a corrosion rate of 0.075-0.078 mpy (mils per year).

In some embodiments, the measured corrosion rate of the material in a 3.5% Sodium Chloride solution for 16 hours according to G-59/G-61 is below 0.1 mpy. In some embodiments, the measured corrosion rate of the material in a 3.5% Sodium Chloride solution for 16 hours according to G-59/G-61 is below 0.08 mpy.

In some embodiments, the alloys disclosed herein, for example P82-X18, can be used in exchange for nickel or other common materials as the metal component in carbide metal matrix composites (MMCs). Common examples of the type of MMCs include by weight WC 60 wt. %, Ni 40 wt. %. Utilizing P82-X18 in this example would yield an MMC of the type: WC 60 wt. %, P82-X18 40 wt. %. A variety of carbide ratios and carbide types can be used.

Example 5: HVOF Spray Study of P82-X18

P82-X18 was thermally sprayed using the hydrogen fueled HVOF process. The resultant coating had an adhesion strength of 10,000 psi, 700 HV300 Vickers hardness, and an ASTM G65B mass loss of 0.856 (10.4.6 g/$mm^3$ volume loss).

Example 6: HVOF Spray Study of 30% NiCu Agglomerated and Sintered Materials

Two powders were manufactured via the agglomeration and sintering process according to the formulas: 1) 65-75% $WC/Cr_3C_2$+25-35% NiCu alloy and 2) 65-75% $Cr_3C_2$+25-35% NiCu alloy. To clarify the first blend, 65-75% of the total volume fraction of the agglomerated and sintered particle is carbide, the remainder being the NiCu metal alloy. The carbide content of the particle is itself composed of a combination of both WC and $Cr_3C_2$ carbide types. In some embodiments, the $WC/Cr_3C_2$ ratio is from 0 to 100 by volume. In some embodiments, the $WC/Cr_3C_2$ ratio is about 0.33 to 3 by volume. In some embodiments, the $WC/Cr_3C_2$ ratio is about 0.25 to 5 by volume. In some embodiments, the $WC/Cr_3C_2$ ratio is about 0.67 to 1.5. The composition of the NiCu alloy is Cu: 20-40 wt. %, preferably Cu: 25-35 wt. %, still preferably: Cu: 28-34 wt. %, balance Nickel with other common impurities below 3 wt. % each.

Both powders were sprayed via the HVOF process to form coatings which were then tested. Coatings produced from powder 1 and powder 2 demonstrated corrosion rates 0.15 mpy and 0.694 mpy respectively in the 28% $CaCl_2$) electrolyte, pH=9.5 solution. Coatings produced from powder 1 and powder 2 were non-permeable as measured via ECP testing. Coatings produced from powder 1 and powder 2 demonstrated abrasion volume losses in ASTM G65A of 11.3 $mm^3$ and 16.2 $mm^3$ respectively. Coatings produced from powder 1 and powder 2 demonstrated microhardness values of 816 HV300 and 677 HV300 respectively. Coatings produced from both powders had bond strengths in excess of 12,500 psi.

Applications

The alloys described in this disclosure can be used in a variety of applications and industries. Some non-limiting examples of applications of use include: surface mining, marine, power industry, oil and gas, and glass manufacturing applications.

Surface mining applications include the following components and coatings for the following components: Wear resistant sleeves and/or wear resistant hardfacing for slurry pipelines, mud pump components including pump housing or impeller or hardfacing for mud pump components, ore feed chute components including chute blocks or hardfacing of chute blocks, separation screens including but not limited to rotary breaker screens, banana screens, and shaker screens, liners for autogenous grinding mills and semi-autogenous grinding mills, ground engaging tools and hardfacing for ground engaging tools, wear plate for buckets and dump truck liners, heel blocks and hardfacing for heel blocks on mining shovels, grader blades and hardfacing for grader blades, stacker reclaimers, sizer crushers, general wear packages for mining components and other comminution components.

From the foregoing description, it will be appreciated that inventive nickel-based hardfacing alloys and methods of use are disclosed. While several components, techniques and aspects have been described with a certain degree of particularity, it is manifested that many changes can be made in the specific designs, constructions and methodology herein above described without departing from the spirit and scope of this disclosure.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount. If the stated amount is 0 (e.g., none, having no), the above recited ranges can be specific ranges, and not within a particular % of the value. For example, within less than or equal to 10 wt./vol. % of, within less than or equal to 5 wt./vol. % of, within less than or equal to 1 wt./vol. % of, within less than or equal to 0.1 wt./vol. % of, and within less than or equal to 0.01 wt./vol. % of the stated amount.

The disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A hardfacing layer formed from a feedstock material, comprising:

Ni; and a corrosion resistant matrix which is characterized by having, under thermodynamic equilibrium conditions:

hard phases of 1,000 Vickers hardness or greater totaling 5 mol. % or greater; and a matrix proximity of 80% or greater when compared to a known corrosion resistant nickel alloy;

wherein the feedstock material comprises a blend of Monel 400 and at least one of WC and $Cr_3C_2$.

2. The hardfacing layer of claim 1, wherein the known corrosion resistant nickel alloy is represented by the formula Ni: BAL, and X >20 wt. %, wherein X represents at least one of Cu, Cr, or Mo.

3. The hardfacing layer of claim 1, wherein the corrosion resistant matrix is a nickel matrix comprising 20 wt. % or greater of a combined total of chromium and molybdenum.

4. The hardfacing layer of claim 1, wherein, under thermodynamic equilibrium conditions, the corrosion resistant matrix is characterized by having isolated hypereutectic hard phases totaling to 50 mol. % or more of a total hard phase fraction.

5. The hardfacing layer of claim 1, wherein the feedstock material comprises, by wt. %:

Ni; and

Cr: about 7 to about 14.5.

6. The hardfacing layer of claim 1, wherein, under thermodynamic equilibrium conditions, the corrosion resistant matrix is characterized by having:

hard phases totaling 50 mol. % or greater; and a liquidus temperature of 1550 K or lower.

7. The hardfacing layer of claim 1, wherein the feedstock material is selected from the group consisting of, by wt. %:

75-85% WC+15-25% Monel 400;

65-75% WC+25-35% Monel 400;

60-75% WC+25-40% Monel 400;

75-85% $Cr_3C_2$+15-25% Monel 400;

65-75% $Cr_3C_2$+25-35% Monel 400;
60-75% $Cr_3C_2$+25-40% Monel 400;
75-85% $WC/Cr_3C_2$+15-25% Monel 400;
65-75% $WC/Cr_3C_2$+25-35% Monel 400; and
60-75% $WC/Cr_3C_2$+25-40% Monel 400.

8. The hardfacing layer of claim 1, wherein the corrosion resistant matrix comprises a $WC/Cr_3C_2$ ratio of 0.25 to 5 by volume.

9. The hardfacing layer of claim 1, wherein the hardfacing layer comprises:

an ASTM G65A abrasion loss of less than 250 $mm^3$; and two cracks or fewer per square inch when forming the hardfacing layer from a PTA or laser cladding process.

10. The hardfacing layer of claim 1, wherein the hardfacing layer comprises an impermeable HVOF coating which exhibits a corrosion rate of 1 mpy or less in a 28% $CaCl_2$) electrolyte, pH=9.5 environment.

11. The hardfacing layer of claim 1, wherein the hardfacing layer comprises:

a hardness of 650 Vickers or greater; and an adhesion of 9,000 psi or greater when forming the hardfacing layer from a HVOF thermal spray process.

12. The hardfacing layer of claim 1, wherein the hardfacing layer is applied onto a hydraulic cylinder, a tension riser, a mud motor rotor, or an oilfield component application.

13. The hardfacing layer of claim 1, wherein the hardfacing layer comprises:

a hardness of 750 Vickers or greater; and a porosity of 2 volume % or less when forming the hardfacing layer from a HVOF thermal spray process.

14. The hardfacing layer of claim 1, wherein the feedstock material is selected from the group consisting of a powder, a wire, and combinations thereof.

15. The hardfacing layer of claim 1, wherein the hardfacing layer is formed from the feedstock material by a weld overlay process or a thermal spray process.

16. A hardfacing layer formed from a feedstock material, the feedstock material comprising, by wt. %:

Ni;
C: about 0.84-about 1.56;
Cr: about 14-about 26;
Mo: about 8.4-about 15.6;
Nb: about 4.2-about 7.8; and
Ti: about 0.35-about 0.65.

17. The hardfacing layer of claim 16, wherein the hardfacing layer comprises a corrosion resistant matrix which is characterized by having, under thermodynamic equilibrium conditions:

hard phases of 1,000 Vickers hardness or greater totaling 5 mol. % or greater; and a matrix proximity of 80% or greater when compared to a known corrosion resistant nickel alloy.

18. The hardfacing layer of claim 16, wherein the hardfacing layer has a corrosion rate of below 0.1 mpy in a 3.5% sodium chloride solution for 16 hours according to G-59/G-61.

19. A hardfacing layer formed from a feedstock material, comprising:

Ni; and a corrosion resistant matrix which is characterized by having, under thermodynamic equilibrium conditions:

hard phases of 1,000 Vickers hardness or greater totaling 5 mol. % or greater; and a matrix proximity of 80% or greater when compared to a known corrosion resistant nickel alloy;

wherein the corrosion resistant matrix comprises a $WC/Cr_3C_2$ ratio of 0.25 to 5 by volume.

20. A hardfacing layer formed from a feedstock material, comprising:

Ni;

a corrosion resistant matrix which is characterized by having, under thermodynamic equilibrium conditions:

hard phases of 1,000 Vickers hardness or greater totaling 5 mol. % or greater; and a matrix proximity of 80% or greater when compared to a known corrosion resistant nickel alloy; and an impermeable HVOF coating which exhibits a corrosion rate of 1 mpy or less in a 28% $CaCl_2$) electrolyte, pH=9.5 environment.

* * * * *